US012313348B2

(12) United States Patent
Wei et al.

(10) Patent No.: US 12,313,348 B2
(45) Date of Patent: May 27, 2025

(54) FLAT TUBE, MULTI-CHANNEL HEAT EXCHANGER, AND AIR CONDITIONING AND REFRIGERATION SYSTEM

(71) Applicant: SANHUA (HANGZHOU) MICRO CHANNEL HEAT EXCHANGER CO., LTD., Zhejiang (CN)

(72) Inventors: Guangfei Wei, Zhejiang (CN); Jianlong Jiang, Zhejiang (CN); Qiang Gao, Zhejiang (CN); Haobo Jiang, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 522 days.

(21) Appl. No.: 17/614,867

(22) PCT Filed: Jun. 1, 2020

(86) PCT No.: PCT/CN2020/093677
§ 371 (c)(1),
(2) Date: Nov. 29, 2021

(87) PCT Pub. No.: WO2020/239120
PCT Pub. Date: Dec. 3, 2020

(65) Prior Publication Data

US 2022/0236015 A1 Jul. 28, 2022

(30) Foreign Application Priority Data

May 31, 2019 (CN) ..... 201920819017.8
May 31, 2019 (CN) ..... 201920820825.6
May 31, 2019 (CN) ..... 201920820935.2

(51) Int. Cl.
*F28D 7/00* (2006.01)
*F28D 7/16* (2006.01)

(52) U.S. Cl.
CPC ..... *F28D 7/1684* (2013.01)

(58) Field of Classification Search
CPC .. F28D 7/1684; F28D 7/1653; F28D 1/05316; F28D 1/05333; F28D 1/05366;
(Continued)

(56) References Cited

U.S. PATENT DOCUMENTS 1,524,520 A * 1/1925 Junkers ..... F28D 7/085 62/526
4,420,039 A * 12/1983 Dubrovsky ..... F28F 3/027 165/166
(Continued)

FOREIGN PATENT DOCUMENTS

JP H03128167 A 5/1991
JP H03105493 U 10/1991
(Continued)

OTHER PUBLICATIONS

English translation of the Written Opinion and International Search Report of the International Searching Authority dated Aug. 26, 2020 for corresponding International Application No. PCT/CN2020/093677, filed Jun. 1, 2020.
(Continued)

*Primary Examiner* — Travis Ruby
(74) *Attorney, Agent, or Firm* — David D. Brush; Westman, Champlin & Koehler, P.A.

(57) ABSTRACT

A flat tube, a multi-channel heat exchanger, and an air conditioning and refrigeration system. The flat tube has n groups of flow channels extending in a length direction of the flat tube, and the n groups of flow channels are distributed to be spaced apart in a width direction of the flat tube; and a flow cross-sectional area of a first group of the flow channels is A1, . . . , a flow cross-sectional area of $k^{th}$ group of the flow channels is $A_k$, . . . , a flow cross-sectional area
(Continued)

of an $n^{th}$ group of the flow channels is An, $1<k\leq n$, $A_k \geq 1.2 A_{k-1}$, and k is an integer greater than 1.

6 Claims, 8 Drawing Sheets

(58) Field of Classification Search
CPC ..... F28D 1/05383; F28F 2215/00; F28F 2215/04; F28F 2215/08; F28F 13/08; F28F 1/128; F28F 1/126; F28F 1/022; F28F 1/04
See application file for complete search history.

(56) References Cited

U.S. PATENT DOCUMENTS 4,570,700 A * 2/1986 Ohara ..... F28D 1/0478 165/170
5,174,373 A * 12/1992 Shinmura ..... F28D 1/05391 165/146
6,170,565 B1 1/2001 Nishishita
8,234,881 B2 * 8/2012 Yanik ..... F28D 1/05341 62/515
2002/0066554 A1 * 6/2002 Oh ..... F28D 1/0535 165/172
2005/0051317 A1 * 3/2005 Chin ..... F28D 1/05391 165/177
2007/0071920 A1 * 3/2007 Muto ..... F28F 1/022 428/34.4
2009/0154091 A1 * 6/2009 Yatskov ..... F28F 1/022 165/104.33
2009/0166016 A1 * 7/2009 Hu ..... F28D 1/0443 165/151
2010/0089546 A1 * 4/2010 Perez ..... F28D 1/05383 165/41
2013/0299141 A1 11/2013 Jindou et al.
2017/0211892 A1 7/2017 Lim et al.
2017/0241721 A1 * 8/2017 Liang ..... F28F 3/048
2021/0156622 A1 * 5/2021 Jiang ..... F28F 1/022

FOREIGN PATENT DOCUMENTS

JP H10170184 A 6/1998
JP H10253276 A 9/1998
JP 2000266484 A 9/2000
JP 2001059689 A 3/2001
JP 2001330387 A 11/2001
JP 2007120940 A 5/2007

OTHER PUBLICATIONS

Japanese Notice of Reasons for Refusal dated Jan. 10, 2023 for corresponding Japanese Application No. 2021-570771.
Extended European Search Report dated May 10, 2023, for corresponding European Application No. 20815243.9.
International Search Report dated Aug. 11, 2020 for corresponding International Application No. PCT/CN2020/093677, Jun. 1, 2020.
Written Opinion of the International Searching Authority dated Aug. 11, 2020 for corresponding International Application No. PCT/CN2020/093677, filed Jun. 1, 2020.

* cited by examiner

FLAT TUBE, MULTI-CHANNEL HEAT EXCHANGER, AND AIR CONDITIONING AND REFRIGERATION SYSTEM

CROSS-REFERENCE TO RELATED APPLICATIONS

This application is a Section 371 National Stage Application of International Application No. PCT/CN2020/093677, filed Jun. 1, 2020 and published as WO 2020/239120 on Dec. 3, 2020, not in English, which claims priority and rights to Chinese Patent Applications No. 201920820825.6, No. 201920820935.2, and No. 201920819017.8 filed on May 31, 2019, which are incorporated herein by reference in their entireties.

FIELD

Embodiments of this application belong to the technical field of heat exchange device manufacturing, and specifically, relates to a flat tube, a multi-channel heat exchanger with the flat tube, and an air conditioning and refrigeration system with the multi-channel heat exchanger.

BACKGROUND

As an alternative technology for copper tube fin heat exchangers, multi-channel heat exchangers have attracted growing attention in the field of air conditioning technologies, and have developed rapidly in recent years. One of difficulties in the application of multi-channel heat exchangers to the field of air-conditioning heat pumps is that during operating under a low temperature condition, a heat exchange capability decreases rapidly due to frost, thereby greatly reducing heat exchange performance of multi-channel heat exchangers.

SUMMARY

This application is made when the applicant realizes and discovers the following technical problems in a heat exchanger in the related art:

It is found by the applicant that when a heat exchanger in the related art is applied in a heat pump system, a heat exchange temperature difference on a windward side is large, and in an air intake direction, the heat exchange temperature difference decreases and a heat exchange volume of the heat exchanger continuously decreases. In addition, air humidity is also large on the windward side, and decreases along with the air intake direction. As a result, frosting concentrated on the windward side, a wind resistance increase, and an air volume decrease are caused, and a heat exchange capability of the heat exchanger decreases quickly.

Objectives of embodiments of this application are to solve at least one of technical problems existing in the prior art, so as to alleviate a heat exchange capability decrease of a heat exchanger, and improve heat exchange efficiency under a frosting condition.

An air conditioning and refrigeration system according to some embodiments of the present disclosure is provided and includes a multi-channel heat exchanger, wherein the multi-channel heat exchanger includes:

a first header, a second header, and a plurality of flat tubes, wherein the flat tube has a first longitudinal side face and a second longitudinal side face opposite to and parallel to each other in a thickness direction of the flat tube, and a third longitudinal side face and a fourth longitudinal side face opposite to and parallel to each other in a width direction of the flat tube;

wherein a distance between the first longitudinal side face and the second longitudinal side face is less than a distance between the third longitudinal side face and the fourth longitudinal side face; the flat tube has a plurality of flow channels extending in a length direction of the flat tube, and the plurality of flow channels of the flat tube are parallel to each other, and are distributed to be spaced apart in the width direction of the flat tube; a center line of the width direction of the flat tube divides the flat tube into a first part and a second part; a flow cross-sectional area of the first part is A1, a flow cross-sectional area of the second part is A2, and A2>A1; and the first part and the second part of the flat tube are arranged in a direction from an air inlet side to an air outlet side;

wherein the plurality of flat tubes are arranged in parallel in a thickness direction of the flat tube, a first end of the flat tube is connected to the first header, and a second end of the flat tube is connected to the second header, so as to connect the first header and the second header; and wherein air flows through the first part of the flat tube, and then flows through the second part of the flat tube.

An air conditioning and refrigeration system according to some embodiments of the present disclosure is provided and includes a multi-channel heat exchanger includes:

a first header, a second header, and a plurality of the flat tubes, wherein the flat tube has a first longitudinal side face and a second longitudinal side face opposite to and parallel to each other in a thickness direction of the flat tube, and a third longitudinal side face and a fourth longitudinal side face opposite to and parallel to each other in a width direction of the flat tube; a distance between the first longitudinal side face and the second longitudinal side face is less than a distance between the third longitudinal side face and the fourth longitudinal side face; the flat tube has a plurality of flow channels extending in a length direction of the flat tube, and the plurality of flow channels of the same flat tube are parallel to each other, and are distributed to be spaced apart in the width direction of the flat tube; the flat tube is divided in the width direction of the flat tube into a first part, a second part, and a third part with same widths; and a flow cross-sectional area of the first part is A1, a flow cross-sectional area of the second part is A2, a flow cross-sectional area of the third part is A3, A2>A1, and/or A2>A3;

wherein the plurality of flat tubes are arranged in parallel in a thickness direction of the flat tube, a first end of the flat tube is connected to the first header, and a second end of the flat tube is connected to the second header, so as to connect the first header and the second header; and a first part, a second part, and a third part of the flat tube are arranged in a direction from an air inlet side to an air outlet side;

wherein air flows through the first part of the flat tube, and then flows through the second part of the flat tube and then the third part of the flat tube.

A multi-channel heat exchanger is provided and includes:

a first header, a second header, and a plurality of the flat tubes wherein the flat tube has a first longitudinal side face and a second longitudinal side face opposite to and parallel to each other in a thickness direction of the flat tube, and a third longitudinal side face and a fourth longitudinal side face opposite to and parallel to each other in a width direction of the flat tube; a distance between the first longitudinal side face and the second longitudinal side face is less than a distance between the third longitudinal side face and the fourth longitudinal side face; the flat tube has n groups of flow channels extending in a length direction of the flat tube, and the n groups of flow channels are distributed to be spaced apart in the width direction of the flat tube; and a flow cross-sectional area of a first group of the flow channels is A1, a flow cross-sectional area of $k^{th}$ group of the flow channels is $A_k$, a flow cross-sectional area of an $n^{th}$ group of the flow channels is An, $1<k\leq n$, $A_k \geq 1.2\ A_{k-1}$ and k is an integer greater than 1;

wherein the plurality of flat tubes are arranged in parallel in a thickness direction of the flat tube, a first end of the flat tube is connected to the first header, and a second end of the flat tube is connected to the second header, so as to connect the first header and the second header; and a first group of flow channels, a $k^{th}$ group of flow channels, an $n^{th}$ group of flow channels of the flat tube are arranged in a direction from an air inlet side to an air outlet side; and a first to $n^{th}$ group of fins, wherein the first to $n^{th}$ group of fins are all installed between a first longitudinal side face of the flat tube and a second longitudinal side face of an adjacent flat tube, and the first to $n^{th}$ groups of fins are sequentially arranged in a width direction of the flat tube, the first group of fins corresponds to the first group of flow channels, the $k^{th}$ group of fins corresponds to the $k^{th}$ group of flow channels, the $n^{th}$ group of fins corresponds to the $n^{th}$ group of flow channels.

The additional aspects and advantages of this application are partially given in the following description, and some of them become obvious from the following description, or are understood through practice of this application.

BRIEF DESCRIPTION OF THE DRAWINGS

The foregoing and/or additional aspects and advantages of this application become obvious and easy to understand from the description of the embodiments with reference to the accompanying drawings, in which.

Figure 1:
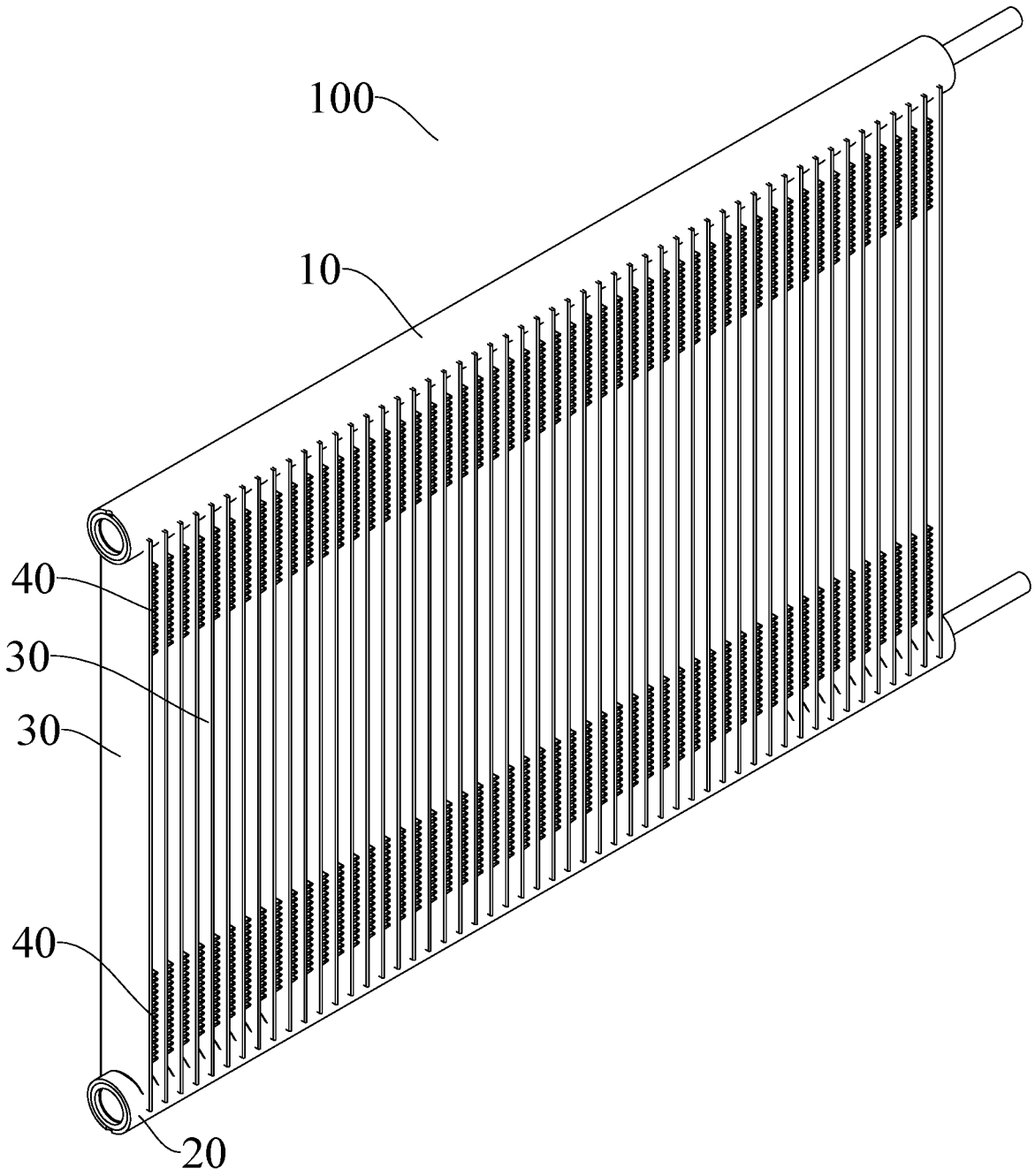
FIG. 1 is a schematic structural diagram of a multi-channel heat exchanger according to an embodiment of this application.

REFERENCE SIGNS multi-channel heat exchanger 100;

first header 10, second header 20;

flat tube 30, first longitudinal side face 30*a*, second longitudinal side face 30*b*, third longitudinal side face 30*c*, fourth longitudinal side face 30*d*, flow channel 30*e*, first part/first group of flow channels 31, second part/second group of flow channels 32, third part 33/third group of flow channels 33, fourth group of flow channels 34, fifth group of flow channels 35, sixth group of flow channels 36, seventh group of flow channels 37; and fin 40, slat 40*a*, first fin/first group of fins 41, second fin/second group of fins 42, notch 43, third fin 44.

DETAILED DESCRIPTION

Embodiments of this application are described in detail below, and examples of the embodiments are shown in the accompanying drawings. Throughout the accompanying drawings, a same or similar number denotes a same or similar component or a component with a same or similar function. The embodiments described below with reference to the accompanying drawings are examples, and are merely intended to explain this application, but shall not be understood as a limitation on this application.

The following describes a multi-channel heat exchanger 100 according to an embodiment of this application with reference to FIG. 1 to FIG. 9 and FIG. 14 to FIG. 16.

Figure 2:
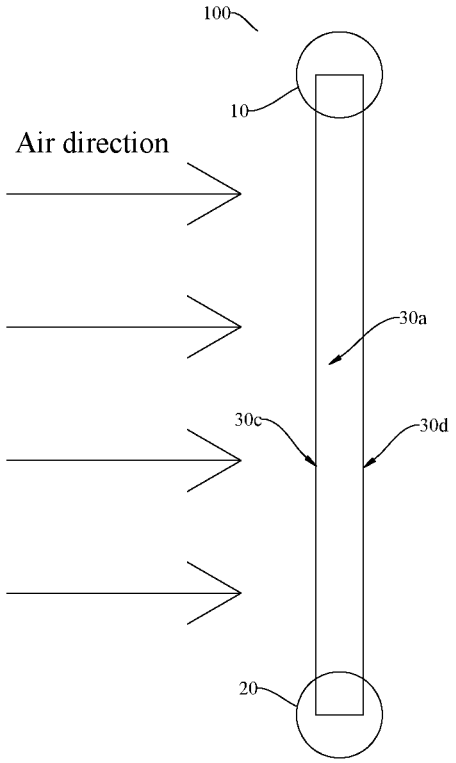
FIG. 2 is a schematic structural diagram of a multi-channel heat exchanger from a side view according to an embodiment of this application (an arrow denotes an air flow direction)

As shown in FIG. 1 and FIG. 2, the multi-channel heat exchanger 100 in this embodiment of this application includes a first header 10, a second header 20, a plurality of flat tubes 30, a plurality of first fins 41, and a plurality of second fins 42.

As shown in FIG. 1, an axial direction of the first header 10 may be parallel to an axial direction of the second header 20, and the first header 10 and the second header 20 may be arranged in parallel and spaced apart from each other. The first header 10 and the second header 20 are distributed in a length direction of the flat tube 30. The first header 10 may be used as an inlet header, the second header 20 may be used as an outlet header; or the first header 10 may be used as an outlet header, and the second header 20 can be used as an inlet header.

The plurality of flat tubes 30 are arranged in parallel in a thickness direction of the flat tube 30, and the thickness direction of the flat tube 30 may be parallel to the axial direction of the first header 10 and the axial direction of the second header 20. The plurality of flat tubes 30 may be disposed to be spaced apart in the axial direction of the first header 10 and the axial direction of the second header 20. A first end of the flat tube 30 is connected to the first header 10, and a second end of the flat tube 30 is connected to the second header 20, so as to connect the first header 10 and the second header 20. In this way, a heat exchange medium can flow along a path: the first header 10—the flat tube 30—the second header 20 or along a path: the second header 20—the flat tube 30—the first header 10. The first header 10 may be provided with a first interface, and the second header 20 may be provided with a second interface. The first interface and the second interface are configured to connect to an external pipeline, so as to connect the heat exchanger to an entire air conditioning system or another heat exchange system.

Figure 5:
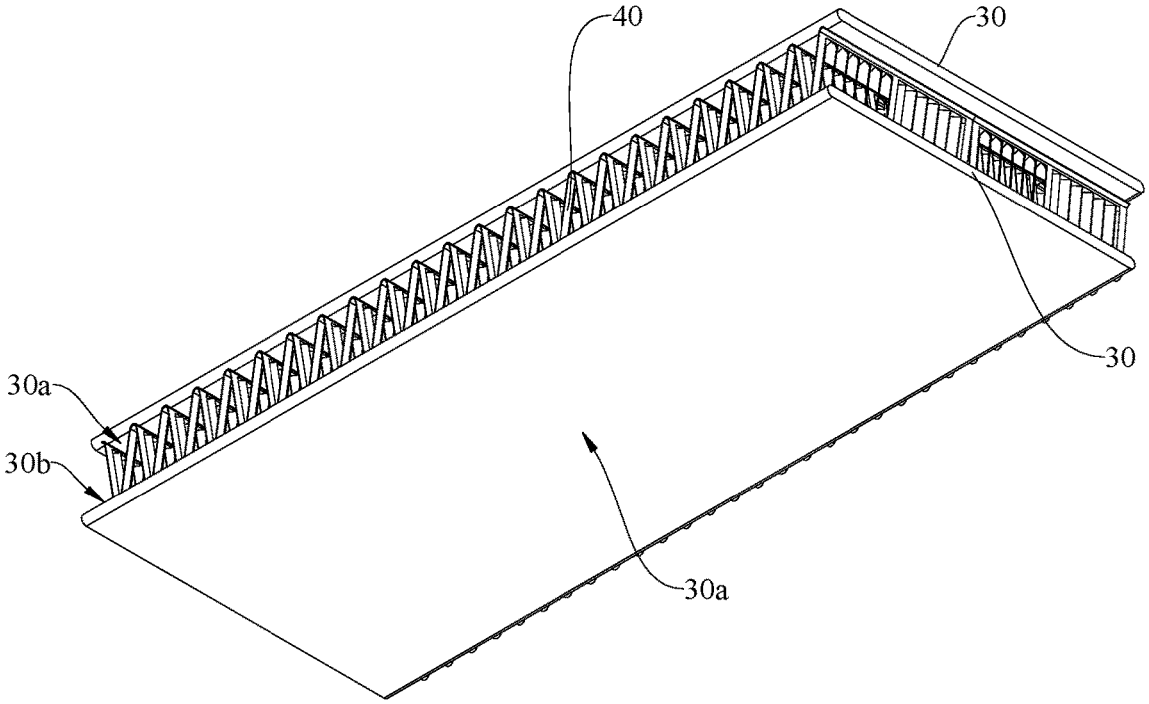
FIG. 5 is a schematic structural diagram of a flat tube and fins of a multi-channel heat exchanger according to an embodiment of this application.
Figure 16:
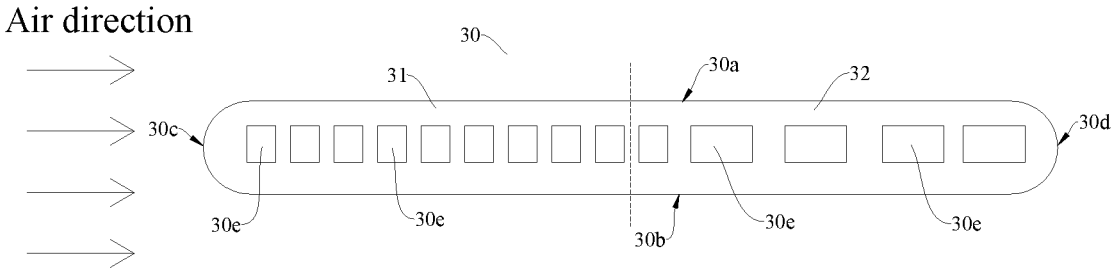
FIG. 16 is a transverse cross-sectional view of a flat tube of a multi-channel heat exchanger according to an embodiment of this application.

As shown in FIG. 2, FIG. 5, and FIG. 16, the flat tube 30 has a first longitudinal side face 30*a*, a second longitudinal side face 30*b*, a third longitudinal side face 30*c*, and a fourth longitudinal side face 30*d*. The first longitudinal side face 30*a* and the second longitudinal side face 30*b* are opposite and parallel to each other in the thickness direction of the flat tube 30, and the third longitudinal side face 30*c* and the fourth longitudinal side face 30*d* are opposite to each other in the width direction of the flat tube 30. A distance between the first longitudinal side face 30*a* and the second longitudinal side face 30*b* is less than a distance between the third longitudinal side face 30*c* and the fourth longitudinal side face 30*d*, that is, a thickness of the flat tube 30 is less than a width of the flat tube 30.

In practical application of the multi-channel heat exchanger 100, air flows through a gap between two flat tubes 30, that is, air passes through the first longitudinal side face 30*a* and the second longitudinal side face 30*b*. As shown in FIG. 16, in the flat tube 30 in this application, the first longitudinal side face 30*a* and the second longitudinal side face 30*b* are arranged in parallel, that is, the thickness of the flat tube 30 is constant in an air intake direction, so that the flat tube 30 has little impact on air flow.

As shown in FIG. 16, the flat tube 30 has a plurality of flow channels 30*e* extending in the length direction of the flat tube 30, and the plurality of flow channels 30*e* of the same flat tube 30 are parallel to each other, and are distributed to be spaced apart in the width direction of the flat tube 30. A center line of the width direction of the flat tube 30 divides the flat tube 30 into a first part 31 and a second part 32. A flow cross-sectional area of the first part 31 is A1, a flow cross-sectional area of the second part 32 is A2, and A2>A1. The first part 31 and the second part 32 of the flat tube 30 are arranged in a direction from an air inlet side to an air outlet side.

It can be understood that if only a heat exchange effect of the flat tube 30 itself is considered, because the flow cross-sectional area of the second part 32 is greater than the flow cross-sectional area of the first part 31, more refrigerant can pass through the cross-sectional area of the second part 32. In this case, a heat exchange effect of the second part 32 of the flat tube 30 is better than that of the first part 31 of the flat tube 30.

A quantity of flow channels 30*e* in the first part 31 may be equal to or different from a quantity of flow channels 30*e* in the second part 32.

In some embodiments, as shown in FIG. 16, the center line of the width direction of the flat tube 30 does not pass through the flow channel 30*e*. In this case, the flow channels 30*e* in the first part 31 all are complete flow channels 30*e*, and the flow channels 30*e* in the second part 32 all are complete flow channels 30*e*. In this case, a sum of flow cross-sectional areas of the flow channels 30*e* in the first part 31 is A1, and a sum of flow cross-sectional areas of the flow channels 30*e* in the second part 32 is A2.

In some other embodiments, the centerline of the width direction of the flat tube 30 passes through one flow channel 30*e*. In this case, a flow channel 30*e* in the middle is divided by the center line into two sections: one located in the first part 31, and the other located in the second part 32. A sum of flow cross-sectional areas of flow channels 30*e* located in the first part 31 and a flow cross-sectional area of a side, located in the first part 31, of the flow channel 30*e* in the middle is A1. A sum of flow cross-sectional areas of flow channels 30*e* located in the second part 32 and a flow cross-sectional area of a side, located in the second part 32, of the flow channel 30*e* in the middle is A2.

Figure 6:
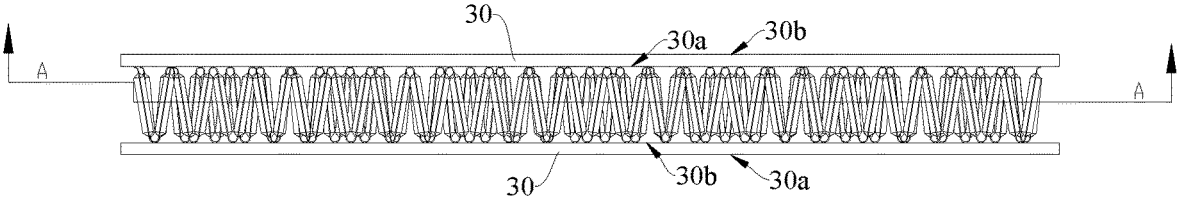
FIG. 6 is a schematic structural diagram of a flat tube and fins of a multi-channel heat exchanger from an end face view according to an embodiment of this application.

As shown in FIG. 6, fins 40 are provided between a first longitudinal side face 30*a* of the flat tube 30 and a second longitudinal side face 30*b* of an adjacent flat tube 30. The fin 40 has two opposite ends in the thickness direction of the flat tube 30. The two ends of the fin 40 are respectively connected to a first longitudinal side face 30*a* and a second longitudinal side face 30*b* of adjacent flat tubes 30.

Figure 7:
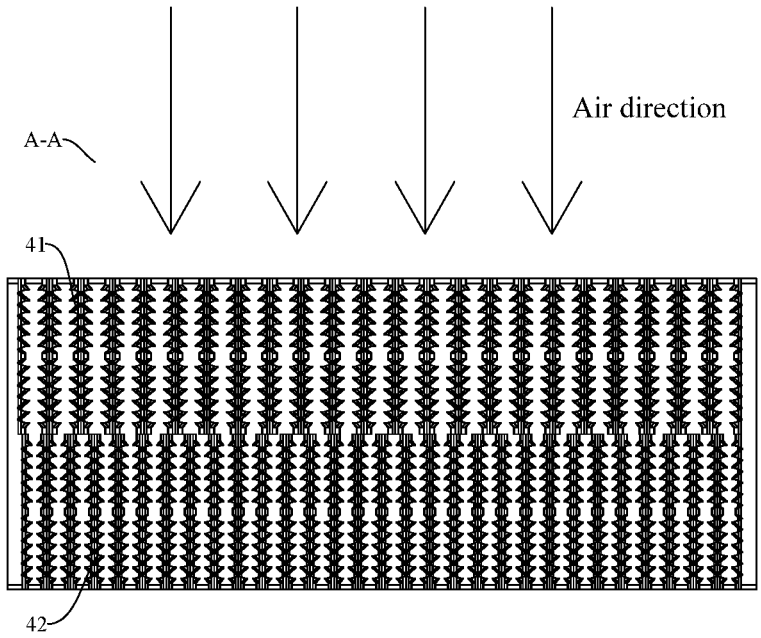
FIG. 7 is a cross-sectional view at A-A in FIG. 6 (an arrow denotes an air flow direction)

As shown in FIG. 5 and FIG. 7, the fins 40 in this application are classified into first fins 41 and second fins 42. The first fins 41 and the second fins 42 are installed between the first longitudinal side face 30*a* of the flat tube 30 and the second longitudinal side face 30*b* of the adjacent flat tube 30, and the first fins 41 and the second fins 42 are arranged in the width direction of the flat tube 30. The first fin 41 has two opposite ends in the thickness direction of the flat tube 30, and the two ends of the first fin 41 are respectively connected to first parts 31 of adjacent flat tubes 30. The second fin 42 has two opposite ends in the thickness direction of the flat tube 30, and the two ends of the second fin 42 are respectively connected to second parts 32 of adjacent flat tubes 30. An air-side heat transfer coefficient of the second fin 42 is greater than an air-side heat transfer coefficient of the first fin 41.

In related art, to improve energy efficiency of a multi-channel heat pump heat exchanger is mainly to improve a problem of frosting. In the case of operating under a low temperature condition, especially when the temperature is about 0° C., water content in the air is large. In this case, an outdoor unit of an air conditioner operates in an evaporator mode, moisture in the air may condense or frost directly, and therefore adhere to the heat exchanger, which will easily cause wind resistance of the heat exchanger to increase and an air volume to decrease, thereby decreasing heat exchange performance of the heat exchanger quickly, and affecting heat exchange efficiency of the heat exchanger.

Figure 8:
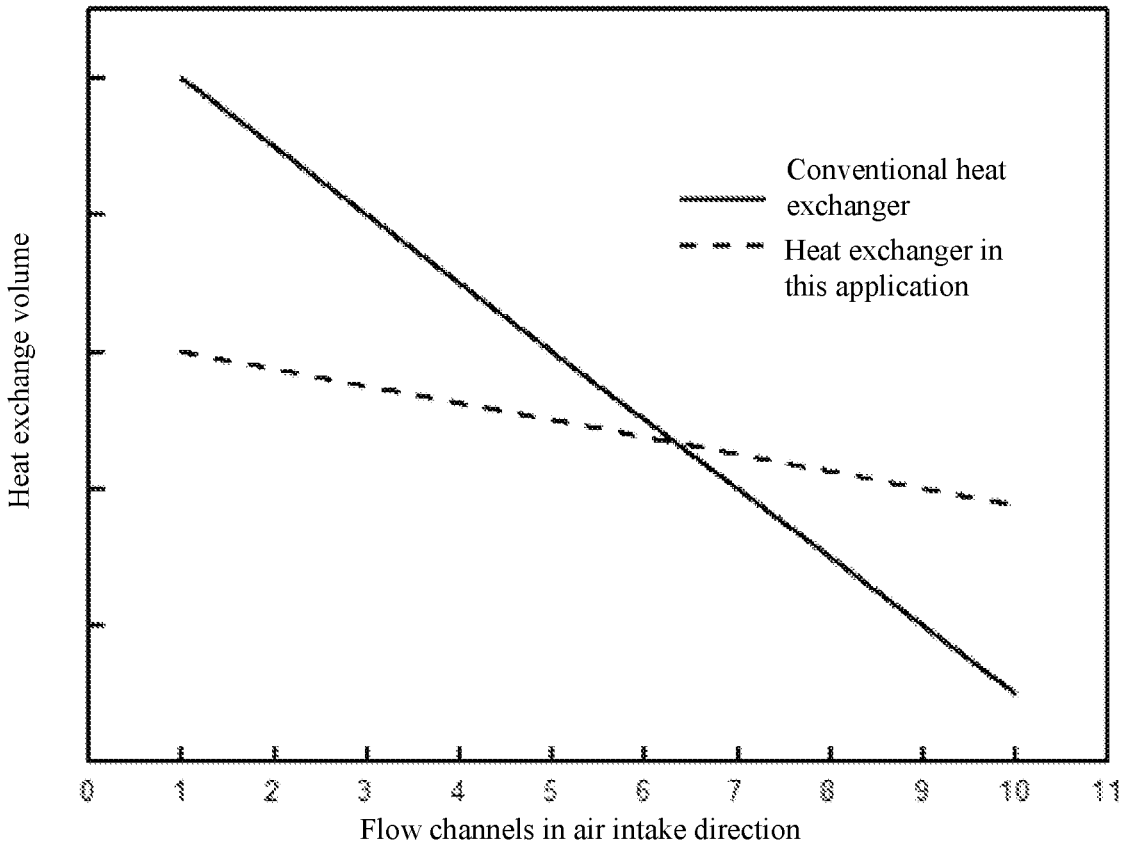
FIG. 8 is a diagram of heat exchange volume comparison between a multi-channel heat exchanger according to an embodiment of this application and a conventional multi-channel heat exchanger.
Figure 9:
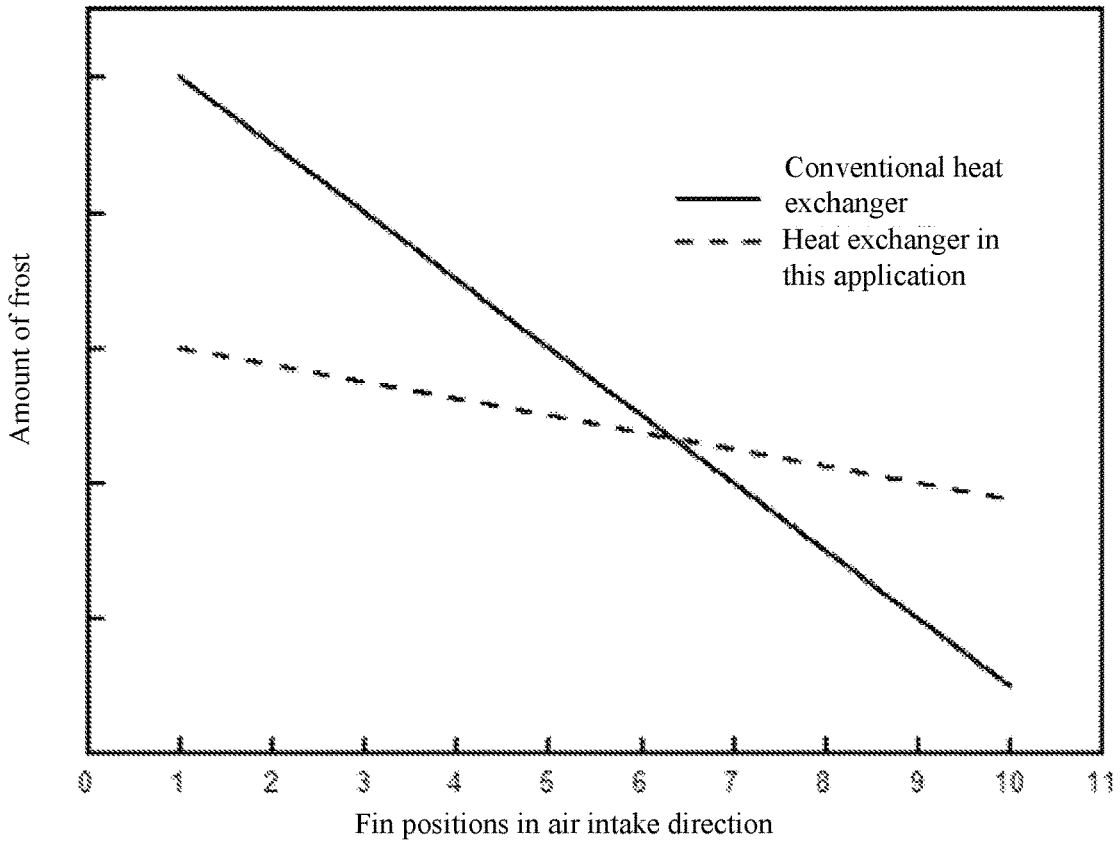
FIG. 9 is a diagram of frosting amount comparison between a multi-channel heat exchanger according to an embodiment of this application and a conventional multi-channel heat exchanger.

In the related art, a plurality of flow channels in a flat tube are uniformly arranged, structures of the flow channels are the same, and corresponding fins are also arranged in a same manner. As shown in FIG. 8 and FIG. 9, for a flat tube of such a structure, during actual use, a heat exchange temperature difference on a windward side is relatively large, and therefore a heat exchange volume of the heat exchanger on the windward side is large. A heat exchange volume of the heat exchanger on a leeward side is relatively small, and in addition, air on the windward side has a large moisture content. There is a large amount of frost in a fin region on the windward side, and there is a relatively small amount of frost on fins on the leeward side. In this way, the windward side may be easily blocked by a large amount of frost, thereby decreasing heat exchange performance of the heat exchanger quickly, and affecting a heat exchange effect of the entire heat exchanger.

As shown in FIG. 8 and FIG. 9, in the multi-channel heat exchanger 100 in this application, the flow cross-sectional area of the second part 32 on the leeward side is designed to be greater larger than that of the first part 31 on the windward side, and the air-side heat transfer coefficient of the second fin 42 on the leeward side is greater than the air-side heat transfer coefficient of the first fin 41 on the windward side. This can balance impact of reduction of the heat exchange temperature difference on the heat exchange volume and the amount of frost to an extent, and can improve the heat exchange volume on the leeward side, reduce the amount of frost on the windward side, and alleviate a heat exchange performance decrease. An overall heat exchange effect can be greatly improved.

It should be noted that the windward side mentioned above means a side through which air flows first, and the leeward side mentioned above means a side through which air flows later, that is, the air flows through the first part 31 of the flat tube 30 and then flows through the second part 32 of the flat tube 30.

According to the multi-channel heat exchanger 100 in this application, cross-sectional areas of flow channels 30*e* inside the flat tube 30 are designed in combination with air-side heat transfer coefficients of fins 40 in different regions, so that an internal flow area of the flat tube 30 on the windward side is decreased, to reduce a refrigerant flow volume, and meanwhile to reduce heat exchange between fins on the windward side and the air and reduce heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

In some embodiments, A2≥1.2 A1, for example, A2=1.5 A1. it is found that through a large quantity of experiments that when the flow cross-sectional areas of the first part 31 and the second part 32 meet the foregoing relationship, frost blockage of the heat exchanger can be effectively reduced, the amount of frost is more evenly distributed in the width direction of the flat tube, and heat exchange performance of the heat exchanger is improved under a frosting condition.

In some embodiments, the first part 31 has a plurality of flow channels 30*e*, the second part 32 has a plurality of flow channels 30*e*, and a flow cross-sectional area of any one of the flow channels 30*e* located in the first part 31 is less than a flow cross-sectional area of any one of the flow channels 30*e* located in the second part 32.

In some embodiments, as shown in FIG. 16, the first part 31 has a plurality of flow channels 30*e*, the second part 32 has a plurality of flow channels 30*e*, and a flow cross-sectional area of any one of the flow channels 30*e* located in the first part 31 is less than a flow cross-sectional area of at least one flow channel 30*e* located in the second part 32.

In some embodiments, as shown in FIG. 16, lengths of all of the flow channels 30*e* in the thickness direction of the flat tube 30 are the same. In this way, distances from different flow channels 30*e* to the first longitudinal side face 30*a* and the second longitudinal side face 30*b* of the flat tube 30 are equivalent, which helps meet a reliability requirement of the entire multi-channel heat exchanger 100.

The fins 40 of the multi-channel heat exchanger 100 in this embodiment of this application may be of a wavy type or a transversely inserted type. As shown in FIG. 3 to FIG. 7, the fins 40 are of a wavy type, and as shown in FIG. 14, the fins 40 are of a transversely inserted type.

In the embodiment shown in FIG. 3 to FIG. 7, both ends of the plurality of first fins 41 are sequentially connected end to end in the length direction of the flat tube 30 to form a wavy shape, and the plurality of first fins 41 may be formed as a wavy overall fin. One first fin 41 is formed between a crest and a trough of the wavy overall fin that are adjacent, and the crest and the trough of the wavy overall fin are respectively connected to a first longitudinal side face 30*a* and a second longitudinal side face 30*b* of two adjacent flat tubes 30.

Figure 14:
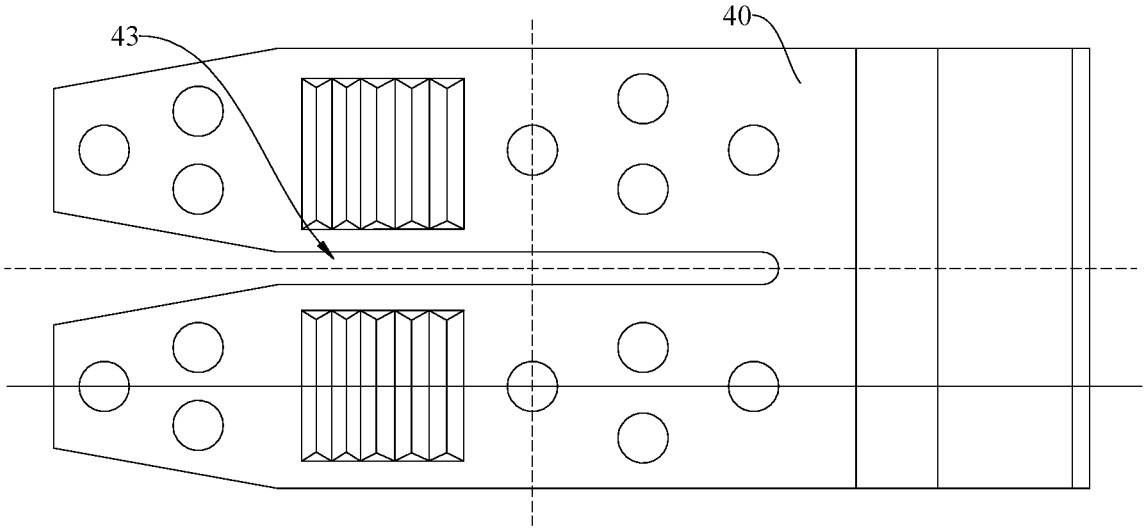
FIG. 14 is a schematic structural diagram of a transversely inserted fin according to an embodiment of this application.
Figure 15:
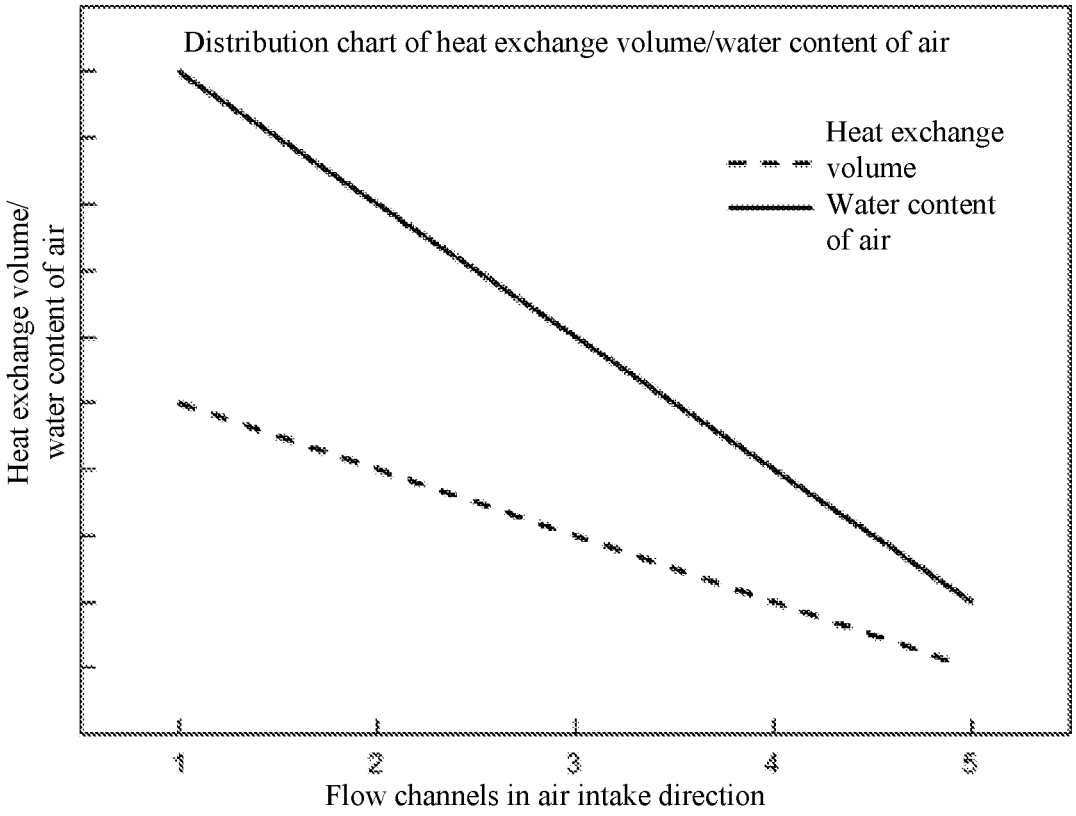
FIG. 15 is a schematic diagram of a heat exchange volume and water content of a heat exchanger.

Certainly, as shown in FIG. 14, the first fin 41 may be of a transversely inserted type. The plurality of first fins 41 are arranged in parallel and spaced apart in the length direction of the flat tube 30, one side of the first fins 41 has a plurality of notches 43, and the first part 31 of the flat tube 30 is separately inserted into the notches 43.

In the embodiment shown in FIG. 3 to FIG. 7, both ends of the plurality of second fins 42 are sequentially connected end to end in the length direction of the flat tube 30 to form a wavy shape, and the plurality of second fins 42 may be formed as a wavy overall fin. One second fin 42 is formed between a crest and a trough of the wavy overall fin that are adjacent, and the crest and the trough of the wavy overall fin are respectively connected to a first longitudinal side face 30*a* and a second longitudinal side face 30*b* of two adjacent flat tubes 30.

Figure 3:
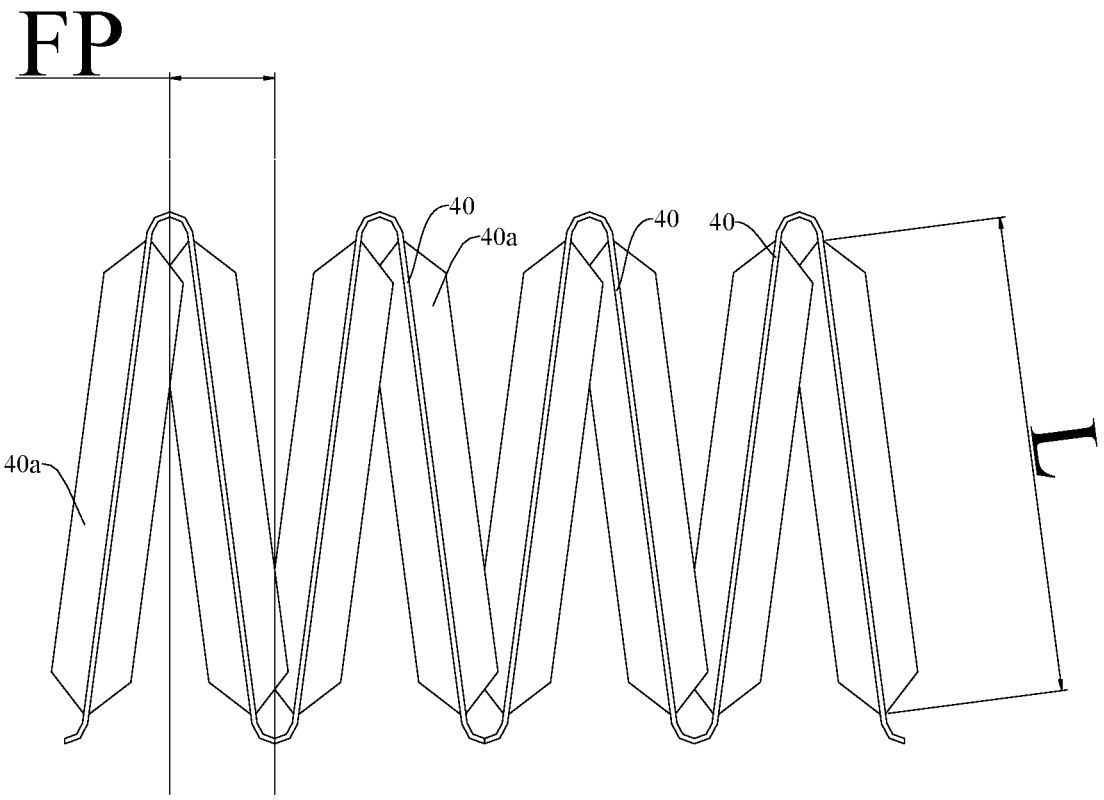
FIG. 3 is a schematic structural diagram of fins of a multi-channel heat exchanger from an angle of view according to an embodiment of this application.

As shown in FIG. 3, a distance between two adjacent fins 40 in the length direction of the flat tube 30 is Fp. When both ends of the plurality of fins 40 are sequentially connected end to end in the length direction of the flat tube 30 to form a wavy shape, Fp is a distance in a wavy length direction between a crest and a trough of the wavy overall fin that are adjacent. In other words, Fp is a distance in the length direction of the flat tube 30 between an end, connected to a first longitudinal side face 30*a*, of the first fin 40 and an end, connected to a second longitudinal side face 30*b*, of the second fin 40. When the fin 40 is of a transversely inserted type, Fp is a surface-to-surface distance of two adjacent fins 40 in the length direction of the flat tube 30.

In some embodiments, a distance between two adjacent first fins 41 in the length direction of the flat tube 30 is Fp1, a distance between two adjacent second fins 42 in the length direction of the flat tube 30 is Fp2, and Fp2<Fp1. In other words, a density of the second fins 42 is larger, so that the second part 32 connected to the second fins 42 can better dissipate heat.

As shown in FIG. 3 to FIG. 7, the fins 40 may be provided with a plurality of slats 40*a* arranged in the width direction of the flat tube 30. As shown in FIG. 3, an louver length of the slat 40*a* of the fin 40 is L, and L is a length of the slat 40*a* along both ends of the fin 40. The louver length L of the slat 40*a* is usually less than a length of the fin 40.

Figure 4:
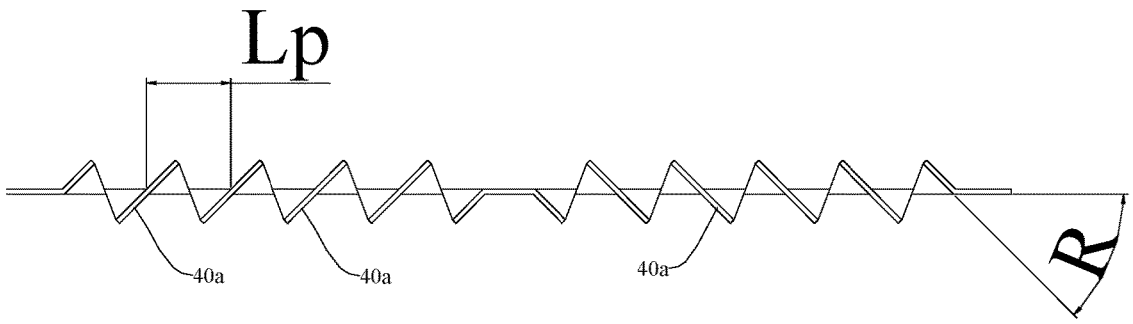
FIG. 4 is a schematic structural diagram of fins of a multi-channel heat exchanger from another angle of view according to an embodiment of this application.

As shown in FIG. 3 to FIG. 7, the fins 40 may be provided with a plurality of slats 40*a* arranged in the width direction of the flat tube 30. As shown in FIG. 4, an louver angle of the slat 40*a* of the fin 40 is R, and the louver angle R of the slat 40*a* is a surface-to-surface angle between the slat 40*a* and a body of the fin 40.

As shown in FIG. 3 to FIG. 7, the fins 40 may be provided with a plurality of slats 40*a* arranged in the width direction of the flat tube 30. As shown in FIG. 4, an louver pitch between slats 40*a* of two adjacent fins 40 is Lp, Lp is a distance in the width direction of the flat tube 30 between slats 40*a* of two adjacent fins 40, for example, a distance from a center point of a slat 40*a* to a center point of its adjacent slat 40*a*.

In some embodiments, the multi-channel heat exchanger 100 has at least one of the following characteristics: a. the first fins 41 and the second fins 42 each are provided with a plurality of slats 40*a* arranged in the width direction of the flat tube 30, an louver length of the slat 40*a* of the first fin 41 is L1, an louver length of the slat 40*a* of the second fin 42 is L2, and L2>L1; b. the first fins 41 and the second fins 42 each are provided with a plurality of slats 40*a* arranged in the width direction of the flat tube 30, an louver angle of the slat 40*a* of the first fin 41 is R1, an louver angle of the slat 40*a* of the second fin 42 is R2, and R2>R1; c. the first fins 41 and the second fins 42 each are provided with a plurality of slats 40*a* arranged in the width direction of the flat tube 30, an louver pitch between slats 40*a* of two adjacent first fins 41 is Lp1, an louver pitch between slats 40*a* of two adjacent second fins 42 is Lp2, and A2/Lp2≥A1/Lp1; or d. the second fin 42 is provided with a plurality of slats 40*a* arranged in the width direction of the flat tube 30, and the first fin 41 is provided with no slats 40*a*.

For example, in an embodiment, the multi-channel heat exchanger 100 meets the following: a. the first fins 41 and the second fins 42 each are provided with a plurality of slats 40*a* arranged in the width direction of the flat tube 30, an louver length of the slat 40*a* of the first fin 41 is L1, an louver length of the slat 40*a* of the second fin 42 is L2, and L2>L1. In this way, an air-side heat transfer coefficient or heat dissipation performance of the second fin 42 is larger than that of the first fin 41, and in combination with the second part 32 having a larger flow cross-sectional area, heat exchange between fins on the windward side and the air can be reduced, thereby reducing heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

In another embodiment, the multi-channel heat exchanger 100 meets the following: b. the first fins 41 and the second fins 42 each are provided with a plurality of slats 40*a* arranged in the width direction of the flat tube 30, an louver angle of the slat 40*a* of the first fin 41 is R1, an louver angle of the slat 40*a* of the second fin 42 is R2, and R2>R1. In other words, the louver angle of the slat 40*a* of the second fin 42 is larger, and the air is more likely to flow into the slat 40*a* of the second fin 42 to exchange heat with the second fin 42. In this way, an air-side heat transfer coefficient or heat dissipation performance of the second fin 42 is larger than that of the first fin 41, and in combination with the second part 32 of the flat tube having a larger flow cross-sectional area, heat exchange between fins on the windward side and the air can be reduced, thereby reducing heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

In still another embodiment, the multi-channel heat exchanger 100 meets the following: c. the first fins 41 and the second fins 42 each are provided with a plurality of slats 40*a* arranged in the width direction of the flat tube 30, an louver pitch between two adjacent first fins 41 is Lp1, an louver pitch between two adjacent second fins 42 is Lp2, and A2/Lp2≥A1/Lp1. A ratio of the flow cross-sectional area of the second part 32 corresponding to the second fins 42 to the louver pitch is larger. In this way, an air-side heat transfer coefficient or heat dissipation performance of the second fin 42 is larger than that of the first fin 41, and in combination with the second part 32 of the flat tube having a larger flow cross-sectional area, heat exchange between fins on the windward side and the air can be further reduced. In addition, heat transfer tolerance of air entering the second fin is improved. Under a frosting condition, a degree of frosting on the windward side can be reduced, thereby reducing frost blockage of the heat exchanger, and further improving heat exchange performance of the heat exchanger under a frosting condition.

In yet another embodiment, the multi-channel heat exchanger 100 meets the following: d. the second fin 42 is provided with a plurality of slats 40*a* arranged in the width direction of the flat tube 30, and the first fin 41 is provided with no slats 40*a*. In this way, an air-side heat transfer coefficient or heat dissipation performance of the second fin 42 provided with the slat 40*a* is larger than that of the first fin 41, and in combination with the second part 32 having a larger flow cross-sectional area, heat exchange between fins on the windward side and the air can be further reduced, thereby accelerating a speed of the air passing through the first fin. In this way, under a frosting condition, a degree of frosting on the windward side can be reduced, thereby reducing frost blockage of the heat exchanger, and further improving heat exchange performance of the heat exchanger under a frosting condition.

In other embodiments, the multi-channel heat exchanger 100 meets a plurality of the foregoing conditions a, b, c, and d. Details are not described herein.

An air conditioning and refrigeration system is further disclosed in this application.

The air conditioning and refrigeration system in this application includes the multi-channel heat exchanger 100 in any one of the foregoing embodiments, and air flows through a first part 31 of a flat tube 30, and then flows through a second part 32 of the flat tube 30. In actual implementation, a fan of the air conditioning and refrigeration system can be disposed facing the multi-channel heat exchanger 100, and in a direction of air passing through the multi-channel heat exchanger 100, the first part 31 of the flat tube 30 is located upstream of the second part 32.

According to the air conditioning and refrigeration system in this application, cross-sectional areas of flow channels 30*e* inside the flat tube 30 are designed in combination with air-side heat transfer coefficients of fins 40 in different regions, to balance heat exchange efficiency on a windward side and a leeward side of the multi-channel heat exchanger 100. Frost is not easy to form, and heat exchange efficiency of air conditioning and refrigeration system is high.

Other components, such as a compressor and throttle valve, and other operations of the air conditioning and refrigeration system according to the embodiments of this application are known to a person of ordinary skill in the art, and details are not described herein.

The following describes a multi-channel heat exchanger 100 according to an embodiment of this application with reference to FIG. 1 to FIG. 9, FIG. 14, FIG. 15, FIG. 17, and FIG. 18.

As shown in FIG. 1 and FIG. 2, the multi-channel heat exchanger 100 in this embodiment of this application includes a first header 10, a second header 20, a plurality of flat tubes 30, a plurality of first fins 41, a plurality of second fins 42, and a plurality of fourth fins 44.

As shown in FIG. 1, an axial direction of the first header 10 may be parallel to an axial direction of the second header 20, and the first header 10 and the second header 20 may be arranged in parallel and spaced apart from each other. The first header 10 and the second header 20 are distributed in a length direction of the flat tube 30. The first header 10 may be used as an inlet header, the second header 20 may be used as an outlet header; or the first header 10 may be used as an outlet header, and the second header 20 can be used as an inlet header.

The plurality of flat tubes 30 are arranged in parallel in a thickness direction of the flat tube 30, and the thickness direction of the flat tube 30 may be parallel to the axial direction of the first header 10 and the axial direction of the second header 20. The plurality of flat tubes 30 may be disposed to be spaced apart in the axial direction of the first header 10 and the axial direction of the second header 20. A first end of the flat tube 30 is connected to the first header 10, and a second end of the flat tube 30 is connected to the second header 20, so as to connect the first header 10 and the second header 20. In this way, a heat exchange medium can flow along a path: the first header 10—the flat tube 30—the second header 20 or along a path: the second header 20—the flat tube 30—the first header 10. The first header 10 may be provided with a first interface, and the second header 20 may be provided with a second interface. The first interface and the second interface are configured to connect to an external pipeline, so as to connect the heat exchanger to an entire air conditioning system or another heat exchange system.

The flat tube 30 in this embodiment of this application is first described with reference to FIG. 18.

Figure 18:
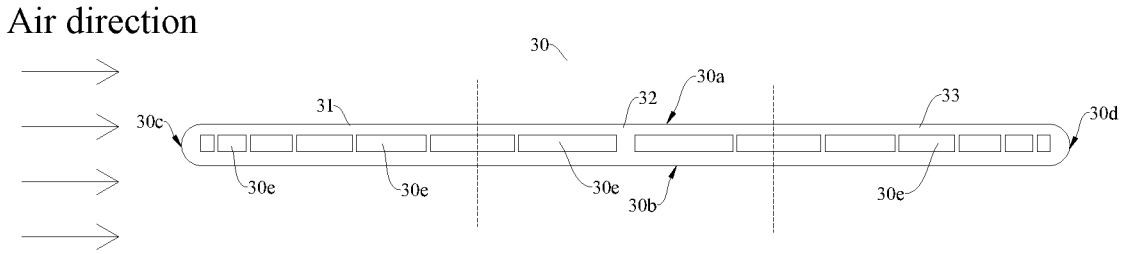
FIG. 18 is a transverse cross-sectional view of a flat tube of a multi-channel heat exchanger according to the embodiment corresponding to FIG. 17.

As shown in FIG. 18, the flat tube 30 has a first longitudinal side face 30*a*, a second longitudinal side face 30*b*, a third longitudinal side face 30*c*, and a fourth longitudinal side face 30*d*. The first longitudinal side face 30*a* and the second longitudinal side face 30*b* are opposite and parallel to each other in the thickness direction of the flat tube 30, and the third longitudinal side face 30*c* and the fourth longitudinal side face 30*d* are opposite to each other in the width direction of the flat tube 30. A distance between the first longitudinal side face 30*a* and the second longitudinal side face 30*b* is less than a distance between the third longitudinal side face 30*c* and the fourth longitudinal side face 30*d*, that is, a thickness of the flat tube 30 is less than a width of the flat tube 30.

In practical application of the multi-channel heat exchanger 100, air flows through a gap between two flat tubes 30, that is, air passes through the first longitudinal side face 30*a* and the second longitudinal side face 30*b*. As shown in FIG. 18, in the flat tube 30 in this application, the first longitudinal side face 30*a* and the second longitudinal side face 30*b* are arranged in parallel, that is, the thickness of the flat tube 30 is constant in an air intake direction, so that the flat tube 30 has little impact on air flow.

As shown in FIG. 18, the flat tube 30 has a plurality of flow channels 30*e* extending in the length direction of the flat tube 30, and the plurality of flow channels 30*e* of the same flat tube 30 are parallel to each other, and are distributed to be spaced apart in the width direction of the flat tube 30. The flat tube 30 is evenly divided in the width direction of the flat tube 30 into a first part 31, a second part 32, and a third part 33. To be specific, the flat tube 30 is evenly divided in the width direction of the flat tube 30 into a first part 31, a second part 32, and a third part 33 that have a same width. A flow cross-sectional area of the first part 31 is A1, a flow cross-sectional area of the second part 32 is A2, a flow cross-sectional area of the third part 33 is A3, A2>A1, and/or A2>A3. The first part 31, the second part 32, and the third part 33 of the flat tube 30 are arranged in a direction from an air inlet side to an air outlet side.

It can be understood that if only a heat exchange effect of the flat tube 30 itself is considered, because the flow cross-sectional area of the second part 32 is greater than the flow cross-sectional area of the first part 31, more refrigerant can pass through the cross-sectional area of the second part 32. In this case, a heat exchange effect of the second part 32 of the flat tube 30 is better than that of the first part 31 of the flat tube 30. Because the flow cross-sectional area of the second part 32 is greater than the flow cross-sectional area of the third part 33, more refrigerant can pass through the cross-sectional area of the second part 32. In this case, the heat exchange effect of the second part 32 of the flat tube 30 is better than that of the third part 33 of the flat tube 30.

A quantity of flow channels 30*e* in the first part 31 may be equal to or different from a quantity of flow channels 30*e* in the second part 32, so as to adjust flow cross-sectional areas.

In some embodiments, trisection lines in the width direction of the flat tube 30 do not pass through the flow channel 30*e*. In this case, the flow channels 30*e* in the first part 31 all are complete flow channels 30*e*, the flow channels 30*e* in the second part 32 all are complete flow channels 30*e*, and flow channels 30*e* in the third part 33 all are complete flow channels 30*e*. In this case, a sum of flow cross-sectional areas of the flow channels 30*e* in the first part 31 is A1, a sum of flow cross-sectional areas of the flow channels 30*e* in the second part 32 is A2, and a sum of flow cross-sectional areas of the flow channels 30*e* in the third part 33 is A3.

In some other embodiments, as shown in FIG. 18, trisection lines in the width direction of the flat tube 30 pass through the flow channel 30*e*. In this case, one or two flow channels 30*e* are divided by the corresponding trisection lines into two parts. In the embodiment shown in FIG. 18, two trisection lines both pass through two flow channels 30*e*. One section of one flow channel 30*e* is located in the first part 31, the other section is located in the second part 32; one section of the other flow channel 30*e* is located in the second part 32, and the other section is located in the third part 33. A1 represents a sum of flow cross-sectional areas of flow channels 30*e* completely located in the first part 31 and a flow cross-sectional area of the section, located on the side of the first part 31, of the flow channel 30*e*. A2 represents a sum of flow cross-sectional areas of flow channels 30*e* completely located in the second part 32 and a flow cross-sectional area of the section, located on the side of the second part 32, of the flow channel 30*e*. A3 represents a sum of cross-sectional areas of flow channels 30*e* completely located in the third part 33 and a flow cross-sectional area of the section, located on the side of the third part 33, of the flow channel 30*e*.

It can be understood that the second part 32 is located in the middle of the width direction of the flat tube 30. During actual use, heat exchange between the first part 31 and the outside and between the third part 33 and the outside air has a good effect, which facilitates installation and use of the flat tube and the heat exchanger.

In related art, to improve energy efficiency of a multi-channel heat pump heat exchanger is mainly to improve a problem of frosting. In the case of operating under a low temperature condition, especially when the temperature is about 0° C., water content in the air is large. In this case, an outdoor unit of an air conditioner operates in an evaporator mode, moisture in the air may condense or frost directly, and therefore adhere to the heat exchanger, which will easily cause wind resistance of the heat exchanger to increase and an air volume to decrease, thereby decreasing heat exchange performance of the heat exchanger quickly, and affecting heat exchange efficiency of the heat exchanger.

In the related art, a plurality of flow channels in the flat tube are uniformly arranged with a same flow channel size. For a flat tube of such a structure, during actual use, as a heat exchange temperature difference of the heat exchanger decreases along with an air intake direction, a heat exchange volume of the heat exchanger on the windward side is large, and a heat exchange volume of the heat exchanger on the leeward side is small. In this way, the windward side of the heat exchanger may be easily blocked by a large amount of frost, thereby affecting a heat exchange effect of the entire heat exchanger.

According to the flat tube 30 in this application, a heat exchange effect of a middle region can be improved or enhanced by designing a flow cross-sectional area in the middle region as the largest, thereby balancing impact of reduction of air intake heat exchange temperature difference on the heat exchange volume to an extent. Reducing a flow cross-sectional area of the flat tube in a windward region can increase a heat exchange volume on the leeward side, reducing frosting on the windward side, and greatly improve an overall heat exchange effect.

It should be noted that the windward side mentioned above means a side through which air flows first, and the leeward side mentioned above means a side through which air flows later, that is, the air flows through the first part 31 of the flat tube 30 and then flows through the second part 32 of the flat tube 30.

According to the flat tube 30 in this application, cross-sectional areas of the flow channels 30*e* inside the flat tube 30 are redesigned so that a flow cross-sectional area in the middle region is the largest. The first part, the second part, and the third part of the flat tube 30 are arranged in a direction from an air inlet side from an air outlet side. In this way, under a frosting condition, a degree of frosting on the windward side can be reduced, thereby reducing frost blockage of a heat exchanger, and further improving heat exchange performance of the heat exchanger under a frosting condition.

In some embodiments, A2≥1.2 A1 or A2≥1.2 A3. In actual implementation, A2≥1.2 A1 and A2≥1.2 A3, for example, A2=1.8 A1, and A2=1.2 A3. It is found by the inventor through a large quantity of experiments that when the flow cross-sectional areas of the first part 31 and the second part 32, and the flow cross-sectional areas of the third part 33 and the second part 32 meet the foregoing relationship, frost blockage of the heat exchanger can be greatly reduced, and refrigerant can be appropriately allocated among the flow channels. A heat exchange capability of the third part 33 can be effectively utilized, thereby further improving heat exchange performance of the heat exchanger under a frosting condition.

In some embodiments, A1=A3. In actual implementation, a plurality of flow channels 30*e* are arranged symmetrically along a center line of the width direction of the flat tube 30 to facilitate extrusion processing and molding of the flat tube 30.

In some embodiments, the first part 31 has a plurality of flow channels 30*e*, the second part 32 has a plurality of flow channels 30*e*, and the third part 33 has a plurality of flow channels 30*e*. A flow cross-sectional area of any one of the flow channels 30*e* located in the first part 31 is less than a flow cross-sectional area of at least one flow channel 30*e* located in the second part 32, and a flow cross-sectional area of any one of the flow channels 30*e* located in the third part 33 is less than a flow cross-sectional area of at least one flow channel 30*e* located in the second part 32.

In some embodiments, as shown in FIG. 18, the first part 31 has a plurality of flow channels 30*e*, the second part 32 has a plurality of flow channels 30*e*, and the third part 33 has a plurality of flow channels 30*e*. A flow cross-sectional area of any one of the flow channels 30*e* located in the first part 31 is less than a flow cross-sectional area of any one of the flow channels 30*e* located in the second part 32, and a flow cross-sectional area of any one of the flow channels 30*e* located in the third part 33 is less than a flow cross-sectional area of any one of the flow channels 30*e* located in the second part 32.

In actual implementation, as shown in FIG. 18, a size of a flow cross-sectional area of the flow channel 30*e* is negatively related to a distance from the flow channel 30*e* to a center line of the width direction of the flat tube 30, and a flow cross-sectional area of a flow channel 30*e* close to the center line of the width direction of the flat tube 30 is larger than a flow cross-sectional area of a flow channel 30*e* away from the center line.

In some embodiments, as shown in FIG. 18, lengths of all of the flow channels 30*e* in the thickness direction of the flat tube 30 are the same. In this way, distances from different flow channels 30*e* to the first longitudinal side face 30*a* and the second longitudinal side face 30*b* of the flat tube 30 are equivalent, which facilitates even heat exchange of the entire multi-channel heat exchanger 100 to improve reliability of the flat tube.

In the multi-channel heat exchanger 100 in this application, as shown in FIG. 6, fins 40 are provided between a first longitudinal side face 30*a* of the flat tube 30 and a second longitudinal side face 30*b* of an adjacent flat tube 30. The fin 40 has two opposite ends in the thickness direction of the flat tube 30. The two ends of the fin 40 are respectively connected to a first longitudinal side face 30*a* and a second longitudinal side face 30*b* of adjacent flat tubes 30.

Figure 17:
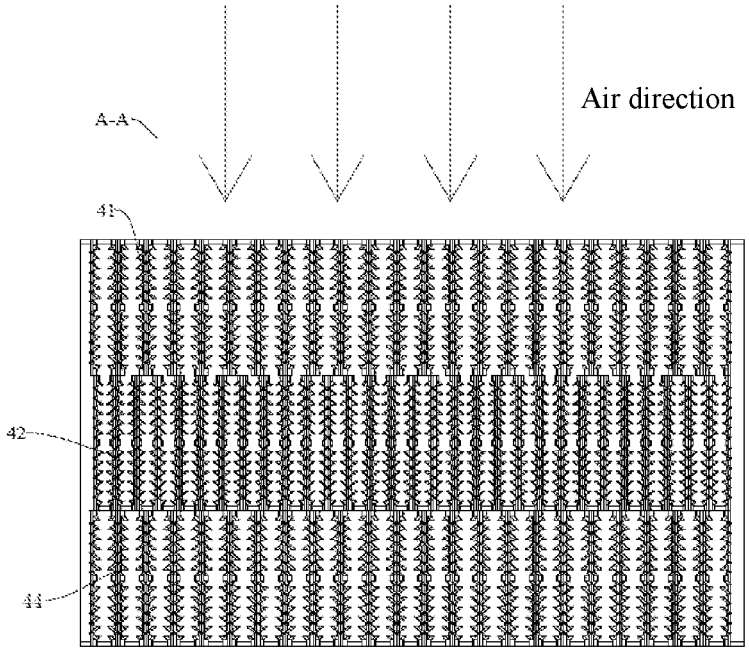
FIG. 17 is a cross-sectional view at A-A in FIG. 6 according to another embodiment (an arrow denotes an air flow direction)

As shown in FIG. 5 and FIG. 17, the fins 40 in this application are classified into first fins 41, second fins 42, and fourth fins 44. The first fins 41, the second fins 42, and the fourth fins 44 are installed between the first longitudinal side face 30*a* of the flat tube 30 and the second longitudinal side face 30*b* of the adjacent flat tube 30, and the first fins 41, the second fins 42, and the fourth fins 44 are sequentially arranged in the width direction of the flat tube 30. The first fin 41 has two opposite ends in the thickness direction of the flat tube 30, and the two ends of the first fin 41 are respectively connected to first parts 31 of adjacent flat tubes 30. The second fin 42 has two opposite ends in the thickness direction of the flat tube 30, and the two ends of the second fin 42 are respectively connected to second parts 32 of adjacent flat tubes 30. The fourth fin 44 has two opposite ends in the thickness direction of the flat tube 30, and the two ends of the fourth fin 44 are respectively connected to third parts 33 of adjacent flat tubes 30.

The flat tube 30 is divided in the width direction into the first part 31, the second part 32, and the third part 33 by flow cross-sectional area, and the first fin 41, the second fin 42, and the fourth fin 44 are correspondingly arranged outside these parts. In this way, a heat dissipation effect of each part can keep at a high level.

According to the multi-channel heat exchanger 100 in this application, cross-sectional areas of the flow channels 30*e* inside the flat tube 30 are redesigned so that a flow cross-sectional area in the middle region is the largest. In this way, under a frosting condition, a heat exchange effect of the middle region, namely, the second part can be improved while reducing a degree of frosting on the windward side and reducing frost blockage of the heat exchanger, thereby further improving heat exchange performance of the heat exchanger under a frosting condition.

The fins 40 of the multi-channel heat exchanger 100 in this embodiment of this application may be of a wavy type or a transversely inserted type. As shown in FIG. 3 to FIG. 9 and FIG. 17, the fins 40 are of a wavy type, and as shown in FIG. 18, the fins 40 are of a transversely inserted type.

In the embodiment shown in FIG. 3 to FIG. 9 and FIG. 17, both ends of the plurality of first fins 41 are sequentially connected end to end in the length direction of the flat tube 30 to form a wavy shape, and the plurality of first fins 41 may be formed as a wavy overall fin. One first fin 41 is formed between a crest and a trough of the wavy overall fin that are adjacent, and the crest and the trough of the wavy overall fin are respectively connected to a first longitudinal side face 30*a* and a second longitudinal side face 30*b* of two adjacent flat tubes 30.

Certainly, as shown in FIG. 14, the first fin 41 may be of a transversely inserted type. The plurality of first fins 41 are arranged in parallel and spaced apart in the length direction of the flat tube 30, one side of the first fins 41 has a plurality of notches 43, and the first part 31 of the flat tube 30 is separately inserted into the notches 43.

In the embodiment shown in FIG. 3 to FIG. 9 and FIG. 17, both ends of the plurality of second fins 42 are sequentially connected end to end in the length direction of the flat tube 30 to form a wavy shape, and the plurality of second fins 42 may be formed as a wavy overall fin. One second fin 42 is formed between a crest and a trough of the wavy overall fin that are adjacent, and the crest and the trough of the wavy overall fin are respectively connected to a first longitudinal side face 30*a* and a second longitudinal side face 30*b* of two adjacent flat tubes 30.

In the embodiment shown in FIG. 3 to FIG. 9 and FIG. 17, both ends of the plurality of fourth fins 44 are sequentially connected end to end in the length direction of the flat tube 30 to form a wavy shape, and the plurality of fourth fins 44 may be formed as a wavy overall fin. One fourth fin 44 is formed between a crest and a trough of the wavy overall fin that are adjacent, and the crest and the trough of the wavy overall fin are respectively connected to a first longitudinal side face 30*a* and a second longitudinal side face 30*b* of two adjacent flat tubes 30.

Certainly, as shown in FIG. 14, the fourth fin 44 may be of a transversely inserted type. The plurality of fourth fins 44 are arranged in parallel and spaced apart in the length direction of the flat tube 30, one side of the fourth fins 44 has a plurality of notches 43, and the third part 33 of the flat tube 30 is separately inserted into the notches 43.

In some embodiments, an air-side heat transfer coefficient of the second fin 42 is greater than an air-side heat transfer coefficient of first fin 41, and the air-side heat transfer coefficient of the second fin 42 is greater than an air-side heat transfer coefficient of the fourth fin 44.

In the related art, a plurality of flow channels in a flat tube are designed in a same manner, and corresponding fins are also designed in a same manner. For a flat tube of such a structure, during actual use, an air heat exchange temperature difference is decreasing, and therefore a heat exchange volume of the heat exchanger is also decreasing. A heat exchange volume of the heat exchanger on the windward side is large, and a heat exchange volume of the heat exchanger on the leeward side is small. The heat exchange volume decreases along with the air intake direction, and in addition, air on the windward side has a largest moisture content. As a result, there is a large amount of frost on fins on the windward side, and there is a small amount of frost on fins on the leeward side. In this way, the windward side may be easily blocked by a large amount of frost, thereby affecting a heat exchange effect of the entire heat exchanger.

According to the multi-channel heat exchanger 100 in this application, the flow cross-sectional area of the second part 32 is designed to be greater larger than that of the first part 31, and the flow cross-sectional area of the second part 32 is designed to be greater larger than that of the third part 33. The air-side heat transfer coefficient of the second fin 42 is greater than the air-side heat transfer coefficient of the first fin 41 on the windward side, and the air-side heat transfer coefficient of the second fin 42 is greater than the air-side heat transfer coefficient of the fourth fin 44. This can balance impact of reduction of the heat exchange temperature difference on the heat exchange volume and the amount of frost, and can improve the heat exchange volume on the leeward side and a heat exchange volume of the flat tube and the fins located on a back side of an air flow direction, and reduce the amount of frost on the windward side. A temperature step difference of the entire heat exchanger is small, and an overall heat exchange effect can be greatly improved.

It should be noted that the windward side mentioned above means a side through which air flows first, and the leeward side mentioned above means a side through which air flows later, that is, the air flows through the first part 31 of the flat tube 30, then flows through the second part 32 of the flat tube 30, and at last, flows through the third part 33 of the flat tube. The first part 31, the second part 32, and the third part 33 of the flat tube 30 are arranged in a direction from an air inlet side from an air outlet side.

According to the multi-channel heat exchanger 100 in this application, cross-sectional areas of flow channels 30*e* inside the flat tube 30 are designed in combination with air-side heat transfer coefficients of fins in different regions, so that an internal flow area of the flat tube 30 on the windward side is decreased, to reduce a refrigerant flow volume, and meanwhile to reduce heat exchange between fins on the windward side and the air and heat exchange of refrigerant with the air, and improve the heat exchange volume of the flat tube and the fins located on the back side of the air flow direction. In this way, under a frosting condition, a degree of frosting on the windward side can be reduced, thereby reducing frost blockage of the heat exchanger, making a frosting position move backward, and further improving heat exchange performance of the heat exchanger under a frosting condition.

As shown in FIG. 3, a distance between two adjacent fins 40 in the length direction of the flat tube 30 is Fp. When both ends of the plurality of fins 40 are sequentially connected end to end in the length direction of the flat tube 30 to form a wavy shape, Fp is a distance in a wavy length direction between a crest and a trough of the wavy overall fin that are adjacent. In other words, Fp is a distance in the length direction of the flat tube 30 between an end, connected to a first longitudinal side face 30*a*, of the first fin 40 and an end, connected to a second longitudinal side face 30*b*, of the second fin 40. When the fin 40 is of a transversely inserted type, Fp is a surface-to-surface distance of two adjacent fins 40 in the length direction of the flat tube 30.

In some embodiments, a distance between two adjacent first fins 41 in the length direction of the flat tube 30 is Fp1, a distance between two adjacent second fins 42 in the length direction of the flat tube 30 is Fp2, a distance between two adjacent fourth fins 44 in the length direction of the flat tube 30 is Fp3, Fp2<Fp1, and/or Fp2<Fp3. In other words, a fin density of the second fins 42 is larger, so that the second part 32 connected to the second fins 42 can better dissipate heat. In this way, under a frosting condition, a status of frosting on the windward side can be reduced, so that more air can rapidly flow to the back side, thereby improving heat exchange performance of the heat exchanger under a frosting condition.

As shown in FIG. 3 to FIG. 9 and FIG. 17, the fins 40 may be provided with a plurality of slats 40*a* arranged in the width direction of the flat tube 30. As shown in FIG. 3, an louver length of the slat 40*a* of the fin 40 is L, and L is a length of the slat 40*a* along both ends of the fin 40. The louver length L of the slat 40*a* is usually less than a length of the fin 40.

As shown in FIG. 3 to FIG. 9 and FIG. 17, the fins 40 may be provided with a plurality of slats 40*a* arranged in the width direction of the flat tube 30. As shown in FIG. 4, an louver angle of the slat 40*a* of the fin 40 is R, and the louver angle R of the slat 40*a* is a surface-to-surface angle between the slat 40*a* and a body of the fin 40.

As shown in FIG. 3 to FIG. 9 and FIG. 17, the fins 40 may be provided with a plurality of slats 40*a* arranged in the width direction of the flat tube 30. As shown in FIG. 4, an louver pitch between slats 40*a* of two adjacent fins 40 is Lp, Lp is a distance in the width direction of the flat tube 30 between slats 40*a* of two adjacent fins 40, for example, a distance from a center point of a slat 40*a* to a center point of its adjacent slat 40*a*.

In some embodiments, the multi-channel heat exchanger 100 has at least one of the following characteristics: a. the first fins 41, the second fins 42, and the fourth fins 44 each are provided with a plurality of slats 40*a* arranged in the width direction of the flat tube 30, an louver length of the slat 40*a* of the first fin 41 is L1, an louver length of the slat 40*a* of the second fin 42 is L2, an louver length of the slat 40*a* of the fourth fin 44 is L3, L2>L1, and/or L2>L3; b. the first fins 41, the second fins 42, and the fourth fins 44 each are provided with a plurality of slats 40*a* arranged in the width direction of the flat tube 30, an louver angle of the slat 40*a* of the first fin 41 is R1, an louver angle of the slat 40*a* of the second fin 42 is R2, an louver angle of the slat 40*a* of the fourth fin 44 is R3, R2>R1, and/or R2>R3; c. the first fins 41, the second fins 42, and the fourth fins 44 each are provided with a plurality of slats 40*a* arranged in the width direction of the flat tube 30, an louver pitch between two adjacent first fins 41 is Lp1, an louver pitch between two adjacent second fins 42 is Lp2, an louver pitch between two adjacent fourth fins 44 is Lp3, Lp2>Lp1, and Lp2>Lp3; or d. the second fin 42 is provided with a plurality of slats 40*a* arranged in the width direction of the flat tube 30, and the first fin 41 and the fourth fin 44 are provided with no slats 40*a*.

For example, in an embodiment, the multi-channel heat exchanger 100 meets the following: a. the first fins 41, the second fins 42, and the fourth fins 44 each are provided with a plurality of slats 40*a* arranged in the width direction of the flat tube 30, an louver length of the slat 40*a* of the first fin 41 is L1, an louver length of the slat 40*a* of the second fin 42 is L2, an louver length of the slat 40*a* of the fourth fin 44 is L3, L2>L1, and/or L2>L3. In this way, an air-side heat transfer coefficient or heat dissipation performance of the second fin 42 is larger than that of the first fin 41, an air-side heat transfer coefficient or heat dissipation performance of the second fin 42 is larger than that of the fourth fin 44, and in combination with the second part 32 having a larger flow cross-sectional area, heat exchange between fins on the windward side and the air can be reduced, thereby reducing heat exchange of refrigerant with the air. In this way, under a frosting condition, a status of frosting on the windward side can be reduced, thereby improving heat exchange performance of the heat exchanger under a frosting condition.

In another embodiment, the multi-channel heat exchanger 100 meets the following: b. the first fins 41, the second fins 42, and the fourth fins 44 each are provided with a plurality of slats 40*a* arranged in the width direction of the flat tube 30, an louver angle of the slat 40*a* of the first fin 41 is R1, an louver angle of the slat 40*a* of the second fin 42 is R2, an louver angle of the slat 40*a* of the fourth fin 44 is R3, and R2>R1, and/or R2>R3. In other words, the louver angle of the slat 40*a* of the second fin 42 is larger, and the air is more likely to flow into the slat 40*a* of the second fin 42 to exchange heat with the second fin 42. In this way, an air-side heat transfer coefficient or heat dissipation performance of the second fin 42 is larger than those of the first fin 41 and the fourth fin 44, and in combination with the second part 32 of the flat tube having a larger flow cross-sectional area, heat exchange between fins on the windward side and the air can be further reduced, thereby reducing heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

In still another embodiment, the multi-channel heat exchanger 100 meets the following: c. the first fins 41, the second fins 42, and the fourth fins 44 each are provided with a plurality of slats 40*a* arranged in the width direction of the flat tube 30, an louver pitch between two adjacent first fins 41 is Lp1, an louver pitch between two adjacent second fins 42 is Lp2, an louver pitch between two adjacent fourth fins 44 is Lp3, Lp2>Lp1, and Lp2>Lp3. The louver pitch of the second fins 42 is larger. In this way, an air-side heat transfer coefficient or heat dissipation performance of the second fin 42 is larger than those of the first fin 41 and the fourth fin 44, and in combination with the second part 32 of the flat tube having a larger flow cross-sectional area, heat exchange between fins on the windward side and the air can be reduced, thereby reducing heat exchange of refrigerant with the air. In this way, under a frosting condition, wind resistance on the windward side can be reduced, and meanwhile, a status of frosting on the windward side can be reduced, thereby reducing frost blockage of the heat exchanger, and further improving heat exchange performance of the heat exchanger under a frosting condition.

In yet another embodiment, the multi-channel heat exchanger 100 meets the following: d. the second fin 42 is provided with a plurality of slats 40*a* arranged in the width direction of the flat tube 30, and the first fin 41 and the fourth fin 44 are provided with no slats 40*a*. An air-side heat transfer coefficient or heat dissipation performance of the second fin 42 provided with the slat 40*a* is larger than those of the first fin 41 and the fourth fin 44, and in combination with the second part 32 having a larger flow cross-sectional area, heat exchange between fins on the windward side and the air can be reduced, thereby reducing heat exchange of refrigerant with the air, so as to facilitate installation and use of the heat exchanger. In addition, under a frosting condition, a heat exchange effect on the windward side is reduced, a heat exchange effect of the middle of the heat exchanger in the air intake direction is enhanced, and a heat exchange temperature difference distribution and a frosting association relationship are adjusted. A degree of frosting on the windward side can be reduced, thereby reducing frost blockage of the heat exchanger, and further improving heat exchange performance of the heat exchanger under a frosting condition.

In other embodiments, the multi-channel heat exchanger 100 meets a plurality of the foregoing conditions a, b, c, and d. Details are not described herein.

An air conditioning and refrigeration system is further disclosed in this application.

The air conditioning and refrigeration system in this application includes the multi-channel heat exchanger 100 in any one of the foregoing embodiments, and air flows through a first part 31 of a flat tube 30, and then flows through a second part 32 of the flat tube 30 and then through a third part 33 of the flat tube 30. In actual implementation, a fan of the air conditioning and refrigeration system can be disposed facing the multi-channel heat exchanger 100, and in a direction of air passing through the multi-channel heat exchanger 100, the first part 31 of the flat tube 30 is located upstream of the second part 32, and the second part 32 of the flat tube 30 is located upstream of the third part 33.

According to the air conditioning and refrigeration system in this application, cross-sectional areas of flow channels 30*e* inside the flat tube 30 are designed in combination with air-side heat transfer coefficients of fins in different regions, to balance heat exchange efficiency on a windward side and a leeward side of the multi-channel heat exchanger 100 and enhance a heat exchange effect of the middle of the heat exchanger. Frost is not easy to form, and heat exchange efficiency of air conditioning and refrigeration system is high.

The following describes a multi-channel heat exchanger 100 according to an embodiment of this application with reference to FIG. 1 to FIG. 13.

As shown in FIG. 1 and FIG. 2, the multi-channel heat exchanger 100 in this embodiment of this application includes a first header 10, a second header 20, a plurality of flat tubes 30, and a first to $n^{th}$ groups of fins.

As shown in FIG. 1, an axial direction of the first header 10 may be parallel to an axial direction of the second header 20, and the first header 10 and the second header 20 may be arranged in parallel and spaced apart from each other. The first header 10 and the second header 20 are distributed in a length direction of the flat tube 30. The first header 10 may be used as an inlet header, the second header 20 may be used as an outlet header; or the first header 10 may be used as an outlet header, and the second header 20 can be used as an inlet header.

The plurality of flat tubes 30 are arranged in parallel in a thickness direction of the flat tube 30, and the thickness direction of the flat tube 30 may be parallel to the axial direction of the first header 10 and the axial direction of the second header 20. The plurality of flat tubes 30 may be disposed to be spaced apart in the axial direction of the first header 10 and the axial direction of the second header 20. A first end of the flat tube 30 is connected to the first header 10, and a second end of the flat tube 30 is connected to the second header 20, so as to connect the first header 10 and the second header 20. In this way, a heat exchange medium can flow along a path: the first header 10—the flat tube 30—the second header 20 or along a path: the second header 20—the flat tube 30—the first header 10. The first header 10 may be provided with a first interface, and the second header 20 may be provided with a second interface. The first interface and the second interface are configured to connect to an external pipeline, so as to connect the heat exchanger to an entire air conditioning system or another heat exchange system.

The flat tube 30 in this embodiment of this application is first described with reference to FIG. 10 to FIG. 13.

As shown in FIG. 10 to FIG. 13, the flat tube 30 has a first longitudinal side face 30*a*, a second longitudinal side face 30*b*, a third longitudinal side face 30*c*, and a fourth longitudinal side face 30*d*. The first longitudinal side face 30*a* and the second longitudinal side face 30*b* are opposite and parallel to each other in the thickness direction of the flat tube 30, and the third longitudinal side face 30*c* and the fourth longitudinal side face 30*d* are opposite to each other in the width direction of the flat tube 30. A distance between the first longitudinal side face 30*a* and the second longitudinal side face 30*b* is less than a distance between the third longitudinal side face 30*c* and the fourth longitudinal side face 30*d*, that is, a thickness of the flat tube 30 is less than a width of the flat tube 30.

In practical application of the multi-channel heat exchanger 100, air flows through a gap between two flat tubes 30, that is, air passes through the first longitudinal side face 30*a* and the second longitudinal side face 30*b*. As shown in FIG. 10 to FIG. 13, in the flat tube 30 in this application, the first longitudinal side face 30*a* and the second longitudinal side face 30*b* are arranged in parallel, that is, the thickness of the flat tube 30 is constant in an air intake direction, so that the flat tube 30 has little impact on air flow.

As shown in FIG. 10 to FIG. 13, the flat tube 30 has n groups of flow channels extending in a length direction of the flat tube 30, and the n groups of flow channels are distributed to be spaced apart in a width direction of the flat tube 30; and a flow cross-sectional area of a first group of the flow channels 31 is A1, . . . , a flow cross-sectional area of $k^{th}$ group of the flow channels is $A_k$, . . . , a flow cross-sectional area of an $n^{th}$ group of the flow channels is An, $1<k\leq n$, $A_k\geq 1.2\ A_{k-1}$, and k is an integer greater than 1.

It can be understood that if only a heat exchange effect of the flat tube 30 itself is considered, because a sum of flow cross-sectional areas of a next group of flow channels in the width direction of the flat tube 30 is 1.2 times greater than a sum of flow cross-sectional areas of a previous group of flow channels, a heat exchange effect of a region of the flat tube 30 is gradually enhanced along with the width direction of the flat tube 30.

In related art, to improve energy efficiency of a multi-channel heat pump heat exchanger is mainly to improve a problem of frosting. In the case of operating under a low temperature condition, especially when the temperature is about 0° C., water content in the air is large. In this case, an outdoor unit of an air conditioner operates in an evaporator mode, moisture in the air may condense or frost directly, and therefore adhere to the heat exchanger, which will easily cause wind resistance of the heat exchanger to increase and an air volume to decrease, thereby decreasing heat exchange performance of the heat exchanger quickly, and affecting heat exchange efficiency of the heat exchanger.

In the related art, as shown in FIG. 8 and FIG. 9, a plurality of flow channels in a flat tube are designed in a same manner. For a flat tube of such a structure, during actual use, a heat exchange temperature difference is decreasing, and therefore a heat exchange volume is decreasing. A heat exchange volume of a region, on a windward side, of the flat tube is large, and a heat exchange volume of a region, on a leeward side, of the flat tube is small. In this way, a temperature step difference of the heat exchanger is large, and a heat exchange effect on the leeward side is poor, thereby affecting a heat exchange effect of the entire heat exchanger.

According to the flat tube 30 in this application, a heat exchange effect of a region on the leeward side can be improved by designing a large flow cross-sectional area in the region on the leeward side, thereby balancing impact of reduction of the heat exchange temperature difference on the heat exchange volume to an extent. A heat exchange volume on the leeward side can be increased, a temperature step difference of the entire heat exchanger is small, and an overall heat exchange effect can be greatly improved.

It should be noted that the windward side mentioned above means a side through which air flows first, and the leeward side mentioned above means a side through which air flows later, that is, the air flows through a region corresponding to the first group of flow channels of the flat tube 30, then flows through a region corresponding to the $k^{th}$ group of flow channels, and at last, flows through a region corresponding to the $n^{th}$ group of flow channels.

According to the flat tube 30 in this application, flow cross-sectional areas of the flow channels 30*e* inside the flat tube 30 are redesigned so as to increase a cross-sectional area of the region on the leeward side. In this way, under a frosting condition, heat exchange of the flat tube on the windward side can be reduced, thereby reducing a difference of heat exchange effects among various part of the flat tube, and further improving overall heat exchange performance of the heat exchanger under a frosting condition.

A quantity of flow channels 30*e* in each group may be the same or different. In the embodiment shown in FIG. 10 to FIG. 13, each group includes a same quantity of flow channels 30*e*.

Figure 10:
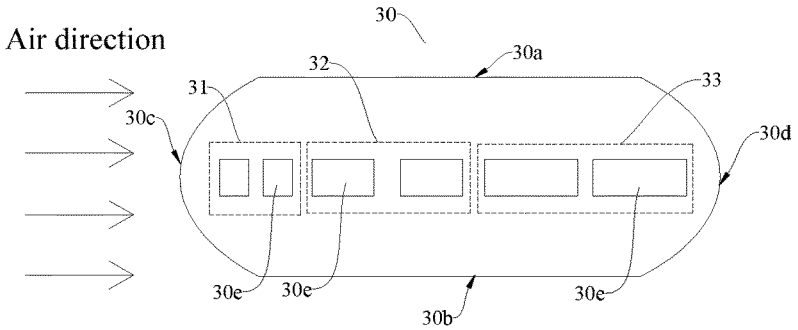
FIG. 10 is a transverse cross-sectional view of a flat tube of a multi-channel heat exchanger according to a first embodiment of this application.
Figure 11:
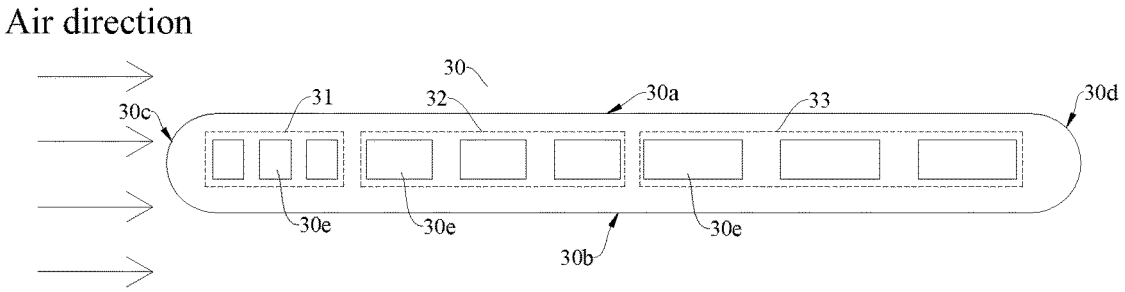
FIG. 11 is a transverse cross-sectional view of a flat tube of a multi-channel heat exchanger according to a second embodiment of this application.
Figure 12:
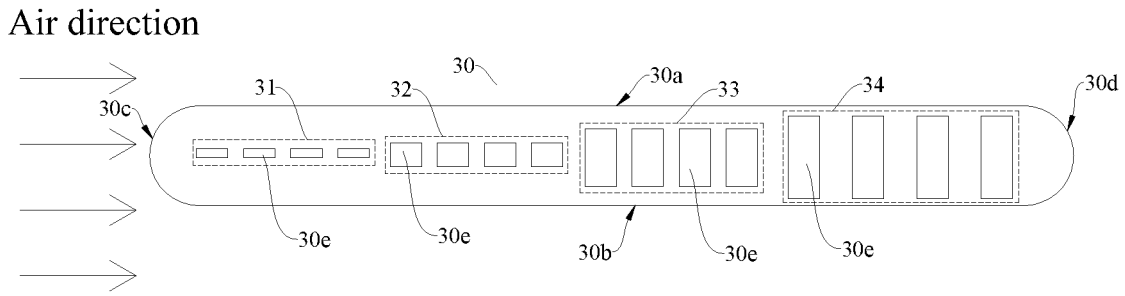
FIG. 12 is a transverse cross-sectional view of a flat tube of a multi-channel heat exchanger according to a third embodiment of this application.
Figure 13:
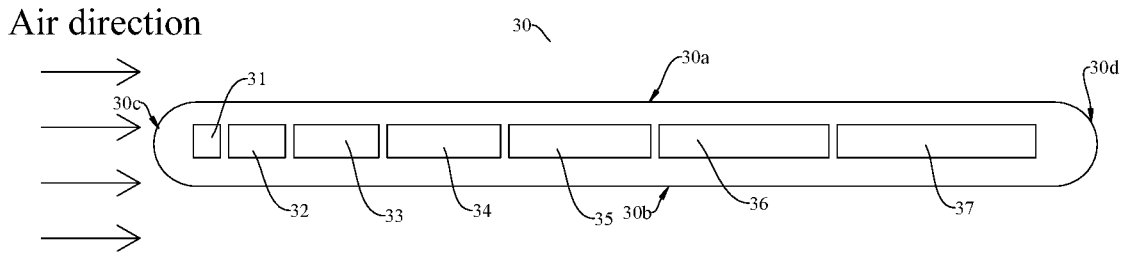
FIG. 13 is a transverse cross-sectional view of a flat tube of a multi-channel heat exchanger according to a fourth embodiment of this application.

In some embodiments, as shown in FIG. 10 to FIG. 12, each group includes a plurality of flow channels 30*e*, and flow cross-sectional areas of all flow channels 30*e* in a same group are equal. Certainly, in some other embodiments, as shown in FIG. 13, each group includes a single flow channel 30*e*.

Shapes of all flow channels 30*e* in a same group are the same, to facilitate extrusion and molding of the flat tube 30.

As shown in FIG. 10, the flat tube 30 has a first group of flow channels 31, a second group of flow channels 32, and a third group of flow channels 33 distributed in the length direction of the flat tube 30. Each group includes two flow channels 30*e*, each flow channel 30*e* of the flat tube 30 is rectangular, and a dimension of each flow channel 30*e* in the thickness direction of the flat tube 30 is equal. A dimension of a flow channel in a next group in the width direction of the flat tube 30 is greater than a dimension of a flow channel in a previous group in the width direction of the flat tube 30.

As shown in FIG. 11, the flat tube 30 has a first group of flow channels 31, a second group of flow channels 32, and a third group of flow channels 33 distributed in the length direction of the flat tube 30. Each group includes three flow channels 30*e*, each flow channel 30*e* of the flat tube 30 is rectangular, and a dimension of each flow channel 30*e* in the thickness direction of the flat tube 30 is equal. A dimension of a flow channel in a next group in the width direction of the flat tube 30 is greater than a dimension of a flow channel 30*e* in a previous group in the width direction of the flat tube 30.

As shown in FIG. 12, the flat tube 30 has a first group of flow channels 31, a second group of flow channels 32, a third group of flow channels 33, and a fourth group of flow channels 34 distributed in the length direction of the flat tube 30. Each group includes four flow channels 30*e*, each flow channel 30*e* of the flat tube 30 is rectangular, and a dimension of each flow channel 30*e* in the width direction of the flat tube 30 is equal. A dimension of a flow channel in a next group in the thickness direction of the flat tube 30 is greater than a dimension of a flow channel 30*e* in a previous group in the thickness direction of the flat tube 30.

As shown in FIG. 13, the flat tube 30 has a first group of flow channels 31, a second group of flow channels 32, a third group of flow channels 33, a fourth group of flow channels 34, a fifth group of flow channels 35, a sixth group of flow channels 36, and a seventh group of flow channels 37 distributed in the length direction of the flat tube 30. Each group includes one flow channel 30*e*, each flow channel 30*e* of the flat tube 30 is rectangular, and a dimension of each flow channel 30*e* in the thickness direction of the flat tube 30 is equal. A dimension of a flow channel in a next group in the width direction of the flat tube 30 is greater than a dimension of a flow channel 30*e* in a previous group in the width direction of the flat tube 30.

In the multi-channel heat exchanger 100 in this application, as shown in FIG. 6, fins 40 are provided between a first longitudinal side face 30*a* of the flat tube 30 and a second longitudinal side face 30*b* of an adjacent flat tube 30. The fin 40 has two opposite ends in the thickness direction of the flat tube 30. The two ends of the fin 40 are respectively connected to a first longitudinal side face 30*a* and a second longitudinal side face 30*b* of adjacent flat tubes 30.

As shown in FIG. 5 to FIG. 7, the fins 40 in this application are classified into a first group of fins 41 to an nth group of fins. The first group of fins 41 to the $n^{th}$ group of fins are all installed between a first longitudinal side face 30*a* of a flat tube 30 and a second longitudinal side face 30*b* of an adjacent flat tube 30, and the first group of fins 41 to the $n^{th}$ groups of fins are sequentially arranged in the width direction of the flat tube 30, the first group of fins 41 corresponds to the first group of flow channels 31, . . . , the $k^{th}$ group of fins corresponds to the $k^{th}$ group of flow channels, . . . , the $n^{th}$ group of fins corresponds to the $n^{th}$ group of flow channels.

The flat tube 30 is provided with n groups of flow channels in the width direction, so that the n groups of flow channels correspond to the n groups of fins, and a heat dissipation effect of each part of the multi-channel heat exchanger 100 can keep at a high level.

According to the multi-channel heat exchanger 100 in this application, cross-sectional areas of the flow channels 30*e* inside the flat tube 30 are redesigned so that a flow cross-sectional area of the flat tube 30 gradually increases along with an air direction. In this way, under a frosting condition, a degree of frosting on the windward side can be reduced, and heat exchange performance of a region, located on a back side of an air intake direction, of the heat exchanger can be enhanced, thereby reducing frost blockage of the heat exchanger, and further improving heat exchange efficiency of the heat exchanger under a frosting condition.

The fins 40 of the multi-channel heat exchanger 100 in this embodiment of this application may be of a wave type or a transversely inserted type. As shown in FIG. 3 to FIG. 7, the fins 40 are of a wave type, and as shown in FIG. 14, the fins 40 are of a transversely inserted type.

In the embodiment shown in FIG. 3 to FIG. 7, both ends of the plurality of fins 40 are sequentially connected end to end in the length direction of the flat tube 30 to form a wavy shape, and the plurality of fins 40 may be formed as a wavy overall fin. One fin 40 is formed between a crest and a trough of the wavy overall fin that are adjacent, and the crest and the trough of the wavy overall fin are respectively connected to a first longitudinal side face 30*a* and a second longitudinal side face 30*b* of two adjacent flat tubes 30.

Certainly, the fin 40 may be of a transversely inserted type. The plurality of fins 40 are arranged in parallel and spaced apart in the length direction of the flat tube 30, one side of the fins 40 has a plurality of notches 43, and the flat tube 30 is separately inserted into the notches 43.

In some embodiments, an air-side heat transfer coefficient of the $k^{th}$ group of fins is greater than an air-side heat transfer coefficient of a $(k-1)^{th}$ group of fins.

In the related art, as shown in FIG. 8 and FIG. 9, a plurality of flow channels in a flat tube are designed in a same manner, and corresponding fins are also designed in a same manner. For a flat tube of such a structure, during actual use, a heat exchange temperature difference is decreasing. Therefore, a heat exchange volume of a region corresponding to the flat tube and the fins on the windward side is large, and a heat exchange volume of a region corresponding to the flat tube and the fins on the leeward side is small. In addition, the air has a decreasing moisture content along with the air intake direction. There is a large amount of frost on the fins on the windward side, and there is a small amount of frost on the fins on the leeward side. In this way, a temperature step difference of the heat exchanger is large, and however, relatively high heat exchange performance leads to a large amount of frost. A heat exchange effect on the leeward side is poor, and the windward side may be easily blocked by a large amount of frost, thereby affecting a heat exchange effect of the entire heat exchanger.

According to the multi-channel heat exchanger 100 in this application, impact of reduction of the heat exchange temperature difference on the heat exchange volume and the amount of frost can be balanced to an extent, and the heat exchange volume on the leeward side can be improved by designing $A_k \geq 1.2\,A_{k-1}$ and designing an air-side heat transfer coefficient of the $k^{th}$ group of fins to be greater than an air-side heat transfer coefficient of a $(k-1)^{th}$ group of fins. The amount of frost on the windward side can be reduced, a heat exchange performance decrease can be alleviated, and an overall heat exchange effect can be greatly improved.

It should be noted that the windward side mentioned above means a side through which air flows first, and the leeward side mentioned above means a side through which air flows later, that is, the air flows through the first group of fins corresponding to the first group of flow channels of the flat tube, then flows through the $k^{th}$ groups of fins corresponding to the $k^{th}$ group of flow channels of the flat tube, and at last, flows through the $n^{th}$ group of fins corresponding to the $n^{th}$ group of flow channels of the flat tube.

According to the multi-channel heat exchanger 100 in this application, cross-sectional areas of flow channels 30*e* inside the flat tube 30 are designed in combination with air-side heat transfer coefficients of fins in different regions, so that an internal flow area of the flat tube 30 on the windward side is decreased, to reduce a refrigerant flow volume, and meanwhile to reduce heat exchange between fins on the windward side and the air and reduce heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

As shown in FIG. 3, a distance between two adjacent fins 40 in the length direction of the flat tube 30 is Fp. When both ends of the plurality of fins 40 are sequentially connected end to end in the length direction of the flat tube 30 to form a wave shape, Fp is a distance in a wave length direction between a crest and a trough of the wavy overall fin that are adjacent. In other words, Fp is a distance in the length direction of the flat tube 30 between an end, connected to a first longitudinal side face 30*a*, of the first fin 40 and an end, connected to a second longitudinal side face 30*b*, of the second fin 40. When the fin 40 is of a transversely inserted type, Fp is a surface-to-surface distance of two adjacent fins 40 in the length direction of the flat tube 30.

In some embodiments, a distance between two adjacent fins 40 in the first group of fins 41 in the length direction of the flat tube 30 is Fp1, a distance between two adjacent fins 40 in the second group of fins 42 in the length direction of the flat tube 30 is Fp2, . . . , a distance between two adjacent fins 40 in the $k^{th}$ group of fins in the length direction of the flat tube 30 is Fpk, . . . , a distance between two adjacent fins 40 in a $n^{th}$ group of fins in the length direction of the flat tube 30 is Fpn, and Fpk>Fp(k−1). In other words, density of a next group of fins is larger, so that a heat exchange effect with the leeward side of the heat exchanger can be effectively improved.

As shown in FIG. 3 to FIG. 7, the fins 40 may be provided with a plurality of slats 40*a* arranged in the width direction of the flat tube 30. As shown in FIG. 3, an louver length of the slat 40*a* of the fin 40 is L, and L is a length of the slat 40*a* along both ends of the fin 40. The louver length L of the slat 40*a* is usually less than a length of the fin 40.

As shown in FIG. 3 to FIG. 7, the fins 40 may be provided with a plurality of slats 40*a* arranged in the width direction of the flat tube 30. As shown in FIG. 4, an louver angle of the slat 40*a* of the fin 40 is R, and the louver angle R of the slat 40*a* is a surface-to-surface angle between the slat 40*a* and a body of the fin 40.

As shown in FIG. 3 to FIG. 7, the fins 40 may be provided with a plurality of slats 40*a* arranged in the width direction of the flat tube 30. As shown in FIG. 4, an louver pitch between slats 40*a* of two adjacent fins 40 is Lp, Lp is a distance in the width direction of the flat tube 30 between slats 40*a* of two adjacent fins 40, for example, a distance from a center point of a slat 40*a* to a center point of its adjacent slat 40*a*.

In some embodiments, the multi-channel heat exchanger 100 has at least one of the following characteristics: a. the first group to the $n^{th}$ group of fins each are provided with a plurality of slats 40*a* arranged in the width direction of the flat tube 30, an louver length of the slat 40*a* of the first group of fins 41 is L1, . . . , an louver length of the slat 40*a* of the $k^{th}$ group of fins is Lk, . . . , an louver length of the slat 40*a* of the $n^{th}$ group of fins is Ln, and Lk>L(k−1); b. the first group to the $n^{th}$ group of fins each are provided with a plurality of slats 40*a* arranged in the width direction of the flat tube 30, an louver angle of the slat 40*a* of the first group of fins 41 is R1, . . . , an louver angle of the slat 40*a* of the $k^{th}$ group of fins is Rk, . . . , an louver angle of the slat 40*a* of the $n^{th}$ group of fins is Rn, and Rk>R(k−1); or c. the first group to the $n^{th}$ group of fins each are provided with a plurality of slats 40*a* arranged in the width direction of the flat tube 30, an louver pitch between two adjacent fins in the first group of fins 41 is Lp1, . . . , an louver pitch between two adjacent fins in the $k^{th}$ group of fins is Lpk, . . . , an louver pitch between two adjacent fins in the $n^{th}$ group of fins is Lpn, and Lpk>Lp(k−1).

For example, in an embodiment, the multi-channel heat exchanger 100 meets the following: a. the first group to the $n^{th}$ group of fins each are provided with a plurality of slats 40*a* arranged in the width direction of the flat tube 30, an louver length of the slat 40*a* of the first group of fins 41 is L1, . . . , an louver length of the slat 40*a* of the $k^{th}$ group of fins is Lk, . . . , an louver length of the slat 40*a* of the $n^{th}$ group of fins is Ln, and Lk>L(k−1). In this way, an air-side heat transfer coefficient or heat dissipation performance of a next group of fins is larger than that of a previous group of fins, and in combination with a next group of flow channels having a larger flow cross-sectional area, heat exchange between fins on the windward side and the air can be further reduced, thereby reducing heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

In another embodiment, the multi-channel heat exchanger 100 meets the following: b. the first group to the $n^{th}$ group of fins each are provided with a plurality of slats 40*a* arranged in the width direction of the flat tube 30, an louver angle of the slat 40*a* of the first group of fins 41 is R1, . . . , an louver angle of the slat 40*a* of the $k^{th}$ group of fins is Rk, . . . , an louver angle of the slat 40*a* of the $n^{th}$ group of fins is Rn, and Rk>R(k−1). In other words, an louver angle of a slat 40*a* of a next group of fins is larger, and the air is more likely to flow into the slat 40*a* of the next group of fins to exchange heat with the next group of fins. In this way, an air-side heat transfer coefficient or heat dissipation performance of a next group of fins is larger than that of a previous group of fins, and in combination with a next group of flow channels having a larger flow cross-sectional area, heat exchange between fins on the windward side and the air can be further reduced, to reduce heat exchange between fins on the windward side and the air and reduce heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

In still another embodiment, the multi-channel heat exchanger 100 meets the following: c. the first group to the $n^{th}$ group of fins each are provided with a plurality of slats 40*a* arranged in the width direction of the flat tube 30, an louver pitch between two adjacent fins in the first group of fins 41 is Lp1, . . . , an louver pitch between two adjacent fins in the $k^{th}$ group of fins is Lpk, . . . , an louver pitch between two adjacent fins in the $n^{th}$ group of fins is Lpn, and Lpk>Lp(k−1). An louver pitch of a next group of fins is larger. In this way, an air-side heat transfer coefficient or heat dissipation performance of a next group of fins is larger than that of a previous group of fins, and in combination with a next group of flow channels having a larger flow cross-sectional area, heat exchange between fins on the windward side and the air can be further reduced, thereby reducing heat exchange of refrigerant with the air. In this way, under a frosting condition, a degree of frosting on the windward side can be reduced, thereby reducing frost blockage of the heat exchanger, and further improving heat exchange performance of the heat exchanger under a frosting condition.

In other embodiments, the multi-channel heat exchanger 100 meets a plurality of the foregoing conditions a, b, and c. Details are not described herein.

An air conditioning and refrigeration system is further disclosed in this application.

The air conditioning and refrigeration system in this application includes the multi-channel heat exchanger 100 in any one of the foregoing embodiments, and air sequentially flows through a first group of fins 41, . . . , a $k^{th}$ group of fins, . . . , an $n^{th}$ group of fins. In actual implementation, a fan of the air conditioning and refrigeration system can be disposed facing the multi-channel heat exchanger 100.

According to the air conditioning and refrigeration system in this application, cross-sectional areas of flow channels 30*e* inside the flat tube 30 are designed in combination with air-side heat transfer coefficients of fins in different regions, to balance heat exchange efficiency on a windward side and a leeward side of the multi-channel heat exchanger 100. Frost is not easy to form, and heat exchange efficiency of air conditioning and refrigeration system is high.

Other components, such as a compressor and throttle valve, and other operations of the air conditioning and refrigeration system according to the embodiments of this application are known to a person of ordinary skill in the art, and details are not described herein.

In the description of this specification, descriptions with reference to terms such as "an embodiment", "some embodiments", "illustrative embodiment", "example", "specific example", or "some examples" mean that specific features, structures, materials, or characteristics described with reference to the embodiment or example are included in at least one embodiment or example of this application. In this specification, illustrative descriptions of the foregoing terms do not necessarily mean a same embodiment or example. Moreover, the described specific features, structures, materials, or characteristics can be combined in any one or more embodiments or examples in an appropriate manner.

Although the embodiments of this application are shown and described, a person of ordinary skill in the art can understand that various changes, modifications, substitutions, and variants can be made based on these embodiments without departing from the principle and purpose of this application. The scope of this application is defined by the claims and their equivalents.

What is claimed is:

1. A multi-channel heat exchanger, comprising:

a first header, a second header, and a plurality of flat tubes, wherein for each of the plurality of flat tubes, the flat tube has a first longitudinal side face and a second longitudinal side face opposite to and parallel to each other in a thickness direction of the flat tube, and a third longitudinal side face and a fourth longitudinal side face opposite to and parallel to each other in a width direction of the flat tube; a distance between the first longitudinal side face and the second longitudinal side face is less than a distance between the third longitudinal side face and the fourth longitudinal side face; the flat tube has n groups of flow channels extending in a length direction of the flat tube, and the n groups of flow channels are distributed to be spaced apart in the width direction of the flat tube; and a flow cross-sectional area of a first group of the flow channels is A1, a flow cross-sectional area of $k^{th}$ group of the flow channels is $A_k$, a flow cross-sectional area of an $n^{th}$ group of the flow channels is An, $1<k\leq n$, $A_k \geq 1.2A_{k-1}$ and k is an integer greater than 1;

wherein the plurality of flat tubes are arranged in parallel in a thickness direction of the flat tubes, a first end of each flat tube is connected to the first header, and a second end of each flat tube is connected to the second header, so as to connect the first header and the second header; and a first group of flow channels, a $k^{th}$ group of flow channels, an $n^{th}$ group of flow channels of the flat tube are sequentially arranged in a direction from an air inlet side to an air outlet side, the first group of flow channels being arranged close to the air inlet side; and a first to $n^{th}$ group of fins, wherein the first to $n^{th}$ group of fins are all installed between a first longitudinal side face of one of the flat tubes of the plurality of flat tubes and a second longitudinal side face of an adjacent flat tube of the plurality of flat tubes, and the first to $n^{th}$ groups of fins are sequentially arranged in a width direction of the flat tubes, the first group of fins corresponds to the first group of flow channels, the $k^{th}$ group of fins corresponds to the $k^{th}$ group of flow channels, the $n^{th}$ group of fins corresponds to the $n^{th}$ group of flow channels;

wherein each of the first to $n^{th}$ groups of fins is provided with a plurality of slats arranged in the width direction of the flat tube, an louver angle of the slat of the first group of fins is R1, an louver angle of the slat of the $k^{th}$ group of fins is Rk, an louver angle of the slat of the $n^{th}$ group of fin is Rn, and Rk>R(k−1).

2. The multi-channel heat exchanger according to claim 1, wherein each group comprises a plurality of the flow channels, and flow cross-sectional areas of all flow channels in a same group are equal.

3. The multi-channel heat exchanger according to claim 1, wherein shapes of all flow channels in a same group are the same.

4. The multi-channel heat exchanger according to claim 2, wherein each group comprises a same quantity of flow channels.

5. The multi-channel heat exchanger according to claim 1, wherein the multi-channel heat exchanger has at least one of the following characteristics:

a. each of the first to $n^{th}$ groups of fins is provided with a plurality of slats arranged in the width direction of the flat tube, an louver length of the slat of the first group of fins is L1, an louver length of the slat of the $k^{th}$ group of fins is Lk, an louver length of the slat of the $n^{th}$ group of fin is Ln, and Lk>L(k−1);

b. each of the first to $n^{th}$ groups of fins is provided with a plurality of slats arranged in the width direction of the flat tube, an louver pitch between two adjacent first fins in the first group of fins is Lp1, an louver pitch between two adjacent first fins in the $k^{th}$ group of fins is Lpk, an louver pitch between two adjacent first fins in the $n^{th}$ group of fin is Lpn, and Lpk>Lp(k−1); or c. a distance between two adjacent fins in the first group of fins in a length direction of the flat tube is Fp1, a distance between two adjacent fins in the $k^{th}$ group of fins in the length direction of the flat tube is Fpk, a distance between two adjacent fins in a $n^{th}$ group of fins in the length direction of the flat tube is Fpn, and Fpk>Fp(k−1).

6. The multi-channel heat exchanger according to claim 1, wherein an air-side heat transfer coefficient of the $k^{th}$ group of fins is greater than an air-side heat transfer coefficient of a (k−1)th group of fins.

* * * * *